US009452343B2

(12) United States Patent
Schröer et al.

(10) Patent No.: US 9,452,343 B2
(45) Date of Patent: Sep. 27, 2016

(54) SKI BINDING WITH FOREFOOT FIXING MODULE

(71) Applicant: Technische Universitat Munchen, Munich (DE)

(72) Inventors: Bernhard Schröer, Hofheim (DE); Hans-Martin Kroll, Munich (DE)

(73) Assignee: Technische Universitat Munchen, Munich (DE)

( * ) Notice: Subject to any disclaimer, the term of this patent is extended or adjusted under 35 U.S.C. 154(b) by 0 days.

(21) Appl. No.: 14/605,696

(22) Filed: Jan. 26, 2015

(65) Prior Publication Data

US 2015/0209650 A1 Jul. 30, 2015

(30) Foreign Application Priority Data

Jan. 24, 2014 (EP) ..... 14000249
Aug. 6, 2014 (EP) ..... 14180081

(51) Int. Cl.
*A63C 9/08* (2012.01)
*A43B 5/04* (2006.01)
(Continued)

(52) U.S. Cl.
CPC ..... *A63C 9/0807* (2013.01); *A43B 5/0421* (2013.01); *A43B 5/0452* (2013.01); *A43B 5/0472* (2013.01); *A43B 5/0492* (2013.01); *A43B 5/0494* (2013.01); *A43B 5/0496* (2013.01); *A63C 9/007* (2013.01); *A63C 9/081* (2013.01); *A63C 9/084* (2013.01); *A63C 9/086* (2013.01); *A63C 9/08542* (2013.01); *A63C 2201/06* (2013.01)

(58) Field of Classification Search
CPC .. A63C 9/20; A63C 2201/06; A43B 5/0413; A43B 5/0492; A43B 5/0496
See application file for complete search history.

(56) References Cited

U.S. PATENT DOCUMENTS 3,863,941 A * 2/1975 Hausleithner ..... A63C 9/001 280/614
3,901,523 A * 8/1975 Burger ..... A63C 9/02 280/614

(Continued)

FOREIGN PATENT DOCUMENTS

DE 202012003704 U1 7/2012
EP 1790396 A2 5/2007

(Continued)

OTHER PUBLICATIONS

European Search and Examination Report, European patent application No. EP 14180081, dated Mar. 18, 2015 [German only].

(Continued)

*Primary Examiner* — Brodie Follman
(74) *Attorney, Agent, or Firm* — Marshall, Gerstein & Borun LLP

(57) ABSTRACT

Shown is a ski binding for fastening a ski boot with a firm or flexible sole onto a ski, which encompasses the following: a forefoot-fixing module with a fastening section and movable section and a support for the heel of the ski boot, wherein the movable section of the forefoot-fixing module encompasses a front receptacle and a rear receptacle, wherein the front and rear receptacle are together suitable for fastening a front section of the ski boot in the forefoot-fixing module, and releasing the latter given a correspondingly high torque. The ski binding has a Telemark downhill mode and/or a climbing mode and/or an alpine downhill mode.

15 Claims, 13 Drawing Sheets

(51) Int. Cl.

| | |
|---|---|
| ***A63C 9/081*** | (2012.01) |
| ***A63C 9/084*** | (2012.01) |
| ***A63C 9/085*** | (2012.01) |
| ***A63C 9/086*** | (2012.01) |
| ***A63C 9/00*** | (2012.01) |

(56) References Cited

U.S. PATENT DOCUMENTS 4,182,524 A * 1/1980 Beyl ..... A63C 9/0846 280/618
4,498,687 A * 2/1985 Salomon ..... A63C 9/20 280/615
4,621,828 A * 11/1986 Adams ..... A63C 9/08507 280/615
4,659,103 A * 4/1987 Tessaro ..... A63C 9/20 280/615
4,836,572 A * 6/1989 Pozzobon ..... A63C 9/20 280/613
4,907,816 A * 3/1990 Dunand ..... A63C 9/20 280/615
4,993,742 A * 2/1991 Wittmann ..... A63C 9/20 280/615
5,044,655 A * 9/1991 Garau ..... A63C 9/20 280/615
5,066,036 A * 11/1991 Broughton ..... A43B 5/0492 280/613
5,190,309 A * 3/1993 Spitaler ..... A63C 9/20 280/615
5,193,840 A * 3/1993 Spitaler ..... A63C 9/20 280/615
5,518,264 A * 5/1996 Broughton ..... A43B 5/0492 280/615
5,671,941 A * 9/1997 Girard ..... A63C 9/20 280/613
5,794,963 A * 8/1998 Girard ..... A63C 9/20 280/615
5,823,563 A * 10/1998 Dubuque ..... A63C 9/20 280/615
5,924,719 A * 7/1999 Girard ..... A63C 9/20 280/613
5,992,873 A * 11/1999 Hauglin ..... A63C 9/18 280/613
6,017,050 A * 1/2000 Girard ..... A43B 5/0413 280/613
6,209,903 B1 * 4/2001 Girard ..... A63C 9/20 280/613
6,375,212 B1 * 4/2002 Hillairet ..... A63C 10/10 280/617
6,390,493 B1 * 5/2002 Hauglin ..... A43B 5/0492 280/613
6,390,494 B2 * 5/2002 Gignoux ..... A43B 5/0492 280/615
6,409,204 B1 * 6/2002 Ayliffe ..... A43B 5/0494 280/613
6,435,537 B2 * 8/2002 Veux ..... A43B 5/0492 280/613
6,644,683 B1 * 11/2003 Hauglin ..... A43B 5/0411 280/613
6,685,213 B2 * 2/2004 Hauglin ..... A63C 9/00 280/615
6,877,759 B2 * 4/2005 Dandurand ..... A63C 9/20 280/605
6,964,428 B2 * 11/2005 Quellais ..... A43B 5/0413 280/613
6,986,526 B2 * 1/2006 Haughlin ..... A63C 9/20 280/613
7,100,938 B2 * 9/2006 Krumbeck ..... A63C 9/0805 280/611
7,111,865 B2 * 9/2006 Girard ..... A43B 5/0413 280/613
7,216,890 B2 * 5/2007 Walker ..... A63C 9/02 280/612
7,264,263 B2 9/2007 Riedel et al.
7,264,264 B2 * 9/2007 Girard ..... A43B 5/0413 280/613
7,306,255 B2 * 12/2007 Walker ..... A63C 9/02 280/614
7,384,057 B2 * 6/2008 Steffen ..... A63C 9/245 280/611
7,396,037 B2 * 7/2008 Walker ..... A63C 9/02 280/614
7,444,769 B2 * 11/2008 Hall ..... A43B 5/0492 36/117.1
7,451,997 B2 * 11/2008 Hauglin ..... A63C 9/20 280/614
7,644,947 B2 * 1/2010 Girard ..... A63C 1/28 280/613
7,681,905 B2 * 3/2010 Hauglin ..... A63C 9/0807 280/611
7,735,851 B2 * 6/2010 Shute ..... A63C 7/1026 280/613
7,832,754 B2 * 11/2010 Girard ..... A63C 9/20 280/613
7,909,352 B2 * 3/2011 Girard ..... A63C 9/0802 280/611
7,931,292 B2 * 4/2011 Miralles ..... A43B 13/141 280/611
8,167,331 B2 * 5/2012 Wollo ..... A63C 9/02 280/619
8,201,845 B2 * 6/2012 Girard ..... A63C 9/20 280/615
8,534,697 B2 * 9/2013 Lengel ..... A63C 9/06 280/617
9,149,710 B2 * 10/2015 Moore ..... A63C 7/12
2001/0002747 A1 * 6/2001 Gignoux ..... A63C 9/20 280/615
2001/0050472 A1 * 12/2001 Veux ..... A63C 9/20 280/614
2003/0047912 A1 * 3/2003 Hauglin ..... A63C 9/00 280/615
2004/0056449 A1 * 3/2004 Girard ..... A63C 1/28 280/615
2004/0164519 A1 * 8/2004 Quellais ..... A43B 5/0413 280/615
2004/0262886 A1 * 12/2004 Girard ..... A43B 5/0413 280/615
2006/0087102 A1 * 4/2006 Coles ..... A63C 9/02 280/626
2007/0108735 A1 * 5/2007 Walker ..... A63C 9/02 280/611
2012/0227286 A1 9/2012 Parisotto et al.
2015/0209650 A1 * 7/2015 Schroer ..... A63C 9/007 280/614

FOREIGN PATENT DOCUMENTS

FR 2843311 A1 2/2004
WO WO-01/66204 A1 9/2001

OTHER PUBLICATIONS

Uploaded by Jarl Berg, Screen shot: NTN+Dynafit = FrankenTele!!!, downloaded from the Internet at: <http://www.youtube.com/watch?y=m-1H3BCorK4, (uploaded on Dec. 30, 2007).

* cited by examiner

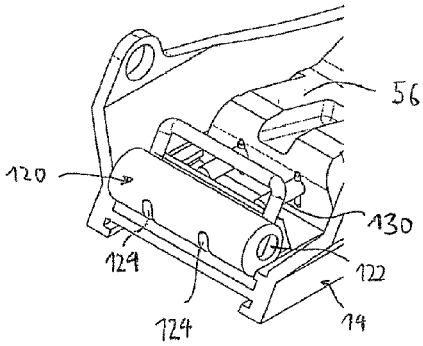
Fig. 13A
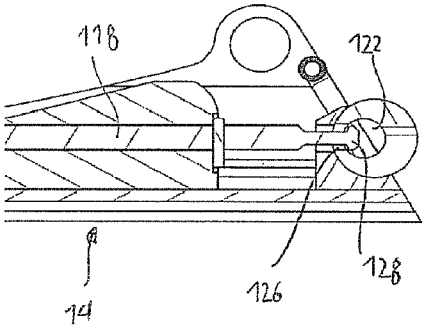
Fig. 13A-S
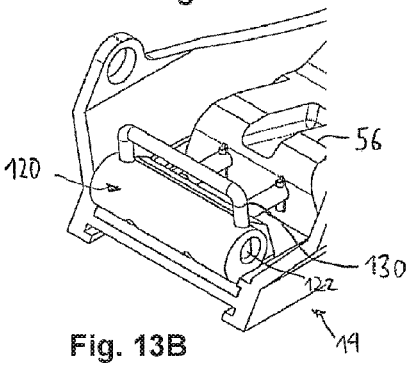
Fig. 13B
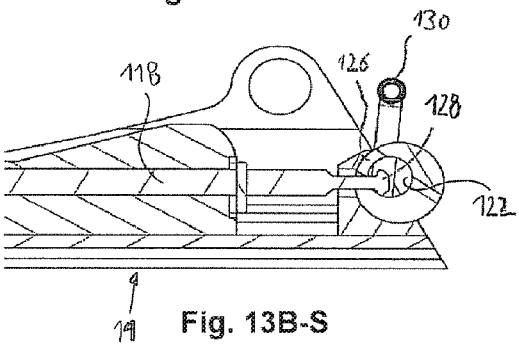
Fig. 13B-S
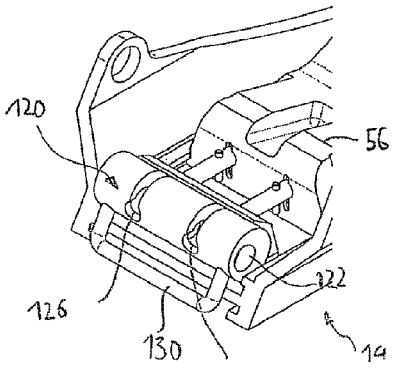
Fig. 13C
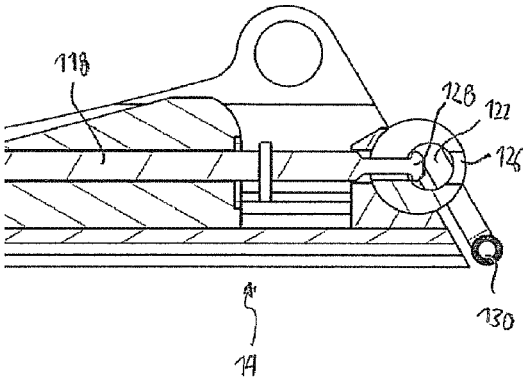
Fig. 13C-S

SKI BINDING WITH FOREFOOT FIXING MODULE

CROSS-REFERENCE TO RELATED APPLICATION

This application claims priority to European Patent Application No. 14 000 249.4 filed Jan. 24, 2014 and European Patent Application No. 14 180 081.3 filed Aug. 6, 2014, the specifications of which are hereby incorporated by reference in their entireties.

FIELD OF THE INVENTION

The present invention relates to a ski binding for fastening a ski boot with a firm or flexible sole onto a ski. More precisely, it comprises a ski binding that has a Telemark downhill mode, a cross-country or climbing mode and/or an alpine downhill mode

BACKGROUND OF THE INVENTION

Skiing is a popular winter recreational activity for many people. In addition to alpine skiing on the piste, there are a number of other different skiing types or techniques.

General social trends suggest that users are also striving toward individualization and active delineation when it comes to skiing. Equipment providers are responding with an appropriate market differentiation. As a result, former niches ski touring, so-called "freeriding" and "freestyle skiing" have developed into separate market segments.

A. Ski Touring

Ski touring describes a form of alpine skiing where the skier is looking not only for downhill runs remote from prepared pistes, but also for the climb for this purpose. While the pure ski tourist tries to do completely without ski lifts and only selects downhill runs that he or she has personally worked out beforehand, off-piste skiing, also referred to as "freeriding", describes an alpine version in which the skier uses an upper terminus of a lift as the starting point for his or her tour. Both share in common the downhill run into unprepared terrain and, even if to a varying extent, the climb.

In order to enable this climb, ski tour and freeride bindings have a climbing function, which allows the heel to release from the automatic heel bracket that is locked for the downhill run, and lets the boot rotate in the area of the toes without resistance.

Two fundamentally different types or mechanisms exist in the area of alpine ski tour binding systems. One type involves so-called plate bindings, in which the entire boot is fastened to a plate or a frame, which in turn is rotatably mounted to the ski. The boot is fastened to the plate or frame with binding elements, which essentially resemble those used under alpine downhill conditions. The rear end of the plate or frame is locked to the ski for the downhill run. In the climbing mode, the rear end of the plate or frame is released, so that the heel of the ski boot can be lifted during a pivoting motion of the plate or frame. However, the plate or frame is rigid, as is the sole of the conventional tour ski boot, so that the foot cannot carry out a rolling movement.

Another alpine ski tour binding system was developed in its basic form already 30 years ago by the Dynafit company, and has in the meantime become broadly used. In this system, the front area of the boot has an insert, which provides a hole-like depression in the sole extension of the ski boot on both sides, into each of which a respective mandrel of the binding engages. As a result, the boot is mounted so that it can rotate around this mandrel relative to the ski. An automatic heel bracket can block this movement, thus allowing a downhill run in the alpine style. To this end, the corresponding boot has another insert in the heel section, into which two pins of the automatic heel bracket engage from behind, preventing the boot from moving both vertically and laterally.

While ski boots with a rigid sole are normally also used even with these frameless types of alpine ski tour bindings, this binding in principle allows the use of ski boots with a flexible sole, even though the sole must be prevented from bending during a downhill run, for example by means of a suitable support, so as to achieve a defined release behavior.

The ski touring boots with a rigid sole, which are the boots used almost exclusively in alpine ski touring, are well-suited for downhill runs, and for climbing in steep terrain, which physiologically resembles "stair stepping", in which the foot rolls only slightly if at all. When striding over an even or slightly inclined terrain, however, a physiological gait would involve a rolling of the foot, which is prevented by the rigid tour ski boots.

B. Telemark Technique

Telemark technique describes a form of skiing in which the heel is not fixed in place on the ski at any time. Historically, alpine skiing has developed from telemark-downhill skiing. Since in the Telemark downhill skiing, a turn is initiated as the result of angular momentum generated by a step change, before the curve is traversed during the lunge, the downhill run is characterized by its Telemark-typical step posture. Herein, the heel of the front outermost foot relative to the curve is fixed in place on the ski during the turn, similarly to the alpine style, while the heel of the innermost foot relative to the curve lifts up to realize a step posture, during which the knee and hip joint are bent, the knee gets closer to the ski, and the ski innermost to the curve is pushed relatively toward the back. As opposed to alpine downhill ski runs and alpine ski touring downhill runs, only the forefoot is rigidly joined with the ski during Telemark downhill runs, while the heel can be lifted from the ski against a resistance that grows as the knee increasingly bends.

Contrary to the climbing function of a ski tour or freeride binding, the forefoot in Telemark bindings is not fixed in place in a translational manner by a hinge, but the boot tip is instead clamped in torque-proof to enable optimal control of the ski. The front boot portion bends to allow the heel to lift, primarily by way of a kink fold provided therein. The ski is controlled by the ball of the foot, which then remains close to the ski even with the heel lifted due to the flexibility of the boot.

When the heel is lifted from the ski and the knee gets closer to the ski during a Telemark turn, this takes place against a resistance generated in part by the bending or "buckling" resistance of the boot, hereinafter also referred to as "boot bending resistance", and in part by a binding bending resistance. As the heel lifts up, this movement is counteracted by the clamping of an often beak-shaped front sole extension into a receptacle (so-called "toe box"), so that the sole bends, and the kink fold area deforms, thereby generating the boot bending resistance. At the same time, however, a restoring torque is also generated by the binding as the heel lifts and the boot bends, which in conjunction with the torque resulting from the boot bending resistance makes it possible to exert pressure on the ski tip, i.e., to actively load the tips of the skis. The precise control of this load constitutes the basis for executing a controlled turn.

The restoring force generated by the Telemark binding while lifting the heel stems from the tensile force in a cable normally used to fix the ski boot in place in the binding, which increases as the heel lifts. This force arises due to the kinematic arrangement of the toe box, cable and heel relative to each other as the boot is kinked by lifting the heel. Herein, however, it turns out that the restoring force generated by the Telemark binding is not ideal, or at least not for all applications. Unfortunately, however, the restoring force or torque generated by the binding cannot be preset as desired in such cable-based bindings. One limiting factor here is that the cable also serves to fix the boot in place in the binding. This means that the tensile force in the cable can at no point be too low. On the other hand, too high a tensile force in the cable causes the boot to be too rigidly fixed in the binding, which then makes it harder to release the boot from the binding in the event of a fall. In this regard, it is particularly problematical that the tensile force in the cable is greatest when the heel is lifted the furthest, i.e., when the knee is bent the most. Studies in sports medicine have shown that susceptibility to ligament injuries is especially high in falls where the knee is bent. However, it is precisely in this injury-prone position that the conventional cable-based Telemark binding usually has the highest release resistance.

Due to this observed safety deficiency, it has been proposed that Telemark bindings be entirely mounted on a release plate, which is released when excessive loads are placed on the ski, similarly to the rotatory safety release of the boot known for alpine ski bindings. In this case, the separation between the ski and skier does not take place between the boot and binding given a safety release, however, but rather inside of the binding, so that part of the binding remains on the boot. This results in a comparatively complicated structural design and cumbersome handling.

As evident from the above description, Telemark bindings and alpine ski tour bindings currently differ fundamentally in their construction, so that structural details from one can hardly be applied to the other, and even less so are shared components used in the disparate binding types, which would be advantageous in the eyes of a manufacturer having both binding types in its product line. There are also no known ski bindings for which the alpine mode and Telemark mode would be options for a downhill run. For the comparatively high number of skiers familiar with alpine downhill runs, this raises the inhibition threshold when it comes to trying the Telemark style, since a complete second set of equipment is required for this purpose. A trained alpine skier with little Telemark experience will often hesitate to stray from the piste wearing exclusively Telemark equipment, fearing that he or she might be unable to master difficult passages in the Telemark style. The ability to switch from the Telemark mode to the alpine downhill mode as needed would tangibly diminish any reservations about enlisting the far less common Telemark technology.

SUMMARY OF THE INVENTION

The object of the present invention is to provide a ski binding and accompanying ski boot, which solves all or parts of the aforementioned problems associated with conventional Telemark bindings and alpine ski tour bindings.

This object is achieved with a ski binding according to claim 1. Advantageous further developments are indicated in the dependent claims.

The ski binding of the present invention is used to fasten a ski boot with a firm or flexible sole onto a ski. The ski binding according to the invention comprises a forefoot-fixing module with a mounting section for mounting onto a ski and a movable section that can be rotated or pivoted relative to the mounting section in such a way that at least a rear end of the movable section can be lifted off the ski. In this regard, "rotated" or "pivoted" does not mean that the motion of the movable section relative to the mounting section must be a purely rotating or pivoting motion. Instead, the relative motion need only have a rotation component, wherein a translational or an additional rotating motion can indeed be superimposed upon the latter.

The ski binding further comprises a support for the heel of the ski boot.

The movable section of the forefoot-fixing module comprises a front receptacle for receiving a front end of the ski boot, in particular a front sole extension of the latter, and a rear receptacle, which is suitable for receiving an engagement element situated on or in the underside or to the side of the sole of the ski boot. The front and rear receptacles are together suitable for fastening a front section of the ski boot in the forefoot-fixing module. The front and/or rear receptacle is further associated with a releasing mechanism, which causes the front section of the ski boot to be released from the forefoot-fixing module once a threshold has been exceeded by a torque of the ski boot relative to the forefoot-fixing module, which torque corresponds to a rotation of the ski boot in the sole plane.

Finally, the ski binding according to the invention provides at least one of the following operating modes:

- A Telemark downhill mode, in which the movable section of the forefoot-fixing module can be rotated or pivoted in relation to the mounting section without the front section of the ski boot received therein being bent or kinked, and in which a spring mechanism generates a restoring force, in particular a restoring torque, between the movable section and the mounting section, which counteracts a lifting of the rear end of the movable section of the forefoot-fixing module from the ski.
- A cross-country or climbing mode, in which the movable section of the forefoot-fixing module can be rotated or pivoted in relation to the mounting section without the front section of the ski boot received therein being bent or kinked, wherein the mechanical coupling between the forefoot-fixing module and mounting section is such that, when the movable section of the forefoot-fixing module rotates or pivots by 35°, a restoring torque between the movable section and the mounting section generates a torque measuring less than 5 Nm, preferably less than 3 Nm, especially preferably less than 2 Nm, even more preferably less than 1 Nm, and in particular zero.
- An alpine downhill mode, in which the heel of the ski boot can be fastened to the support by means of a heel element.

Let it be noted that the Telemark downhill mode described above is intended first and foremost for downhill skiing in the Telemark style. However, a similar style can also be used in ski jumping, for example, and is here to be encompassed as well.

While the ski binding can have all three operating modes in an especially preferred embodiment, the invention also comprises embodiments in which the ski binding only realizes one or two of said modes. The core element of the ski binding in its varying configurations is a respective forefoot-fixing module, which fixes in place a front section of the ski boot by means of a front receptacle and rear receptacle. Descriptively speaking, this forefoot-fixing module makes it possible to "flatly" fix a portion of the ski boot in place without bending this front portion of the ski boot between the front receptacle and rear receptacle. This distinguishes the forefoot-fixing module from known Telemark bindings, in which the boot tip, i.e., the front sole extension or "beak", is clamped in a torque-proof manner, and the sole necessarily bends as the heel in the binding lifts, which for reasons mentioned above brings with it unresolved problems associated with finding a suitable compromise between a reliable release response and a suitable restoring torque.

The forefoot-fixing module also differs from known ski tour bindings, in which only plates or frames with front and rear receptacles that fix the entire boot in place are known as movable sections. In the invention, only the front portion of the boot is held in the forefoot-fixing module, in particular the portion that extends from the front end of the ski boot up to the engagement element, which is located on or in the underside or to the side of the sole of the ski boot. Herein, the length of this section is preferably shorter than half the length of the sole of the ski boot, in particular shorter than one third of the overall length of the boot. The absolute length from the front end of the ski boot, without considering the sole extension that protrudes over the shell of the ski boot at the front, until the rear end of the engagement element is typically shorter than 15 cm, preferably shorter than 13 cm, and in particular shorter than 11.5 cm, so as to allow the sole to kink behind the rear receptacle, thereby enabling a physiological rolling. This length preferably exceeds 4 cm, especially preferably exceeds 5 cm, and in particular exceeds 6 cm. A range of 7 cm to 10 cm has proven to be especially advantageous.

In the mentioned Telemark downhill mode, the spring mechanism generates a restoring force, in particular a restoring torque, between the movable section and the mounting section of the forefoot-fixing module, which corresponds to the binding bending resistance in conventional cable-based Telemark bindings, but also at least partially replaces the contribution of a boot bending resistance in conventional Telemark bindings that is generated by bending the boot in the area of the forefoot, which is no longer present in the invention. However, let it be noted that this no longer involves a "bending resistance" in the proper sense of the term, which was generated by bending the ski boot in the binding, instead the front section of the ski boot received in the forefoot-fixing module is precisely not bent or kinked, but rather "flatly" fixed in place, as explained above. This means that the restoring force/restoring torque can be freely preset by properly designing the spring mechanism, without having to focus on an adequate fixation or potentially too strong a fixation of the boot in the binding. Instead, the release torque for releasing the boot from the binding and the restoring force/restoring torque can be optimally set completely independently from each other.

The front and rear receptacles of the movable section of the forefoot-fixing module are preferably fastened to a rigid plate or a rigid frame.

In an advantageous further development, the restoring force or restoring torque of the spring mechanism can be set according to the physical constitution of the skier, the terrain to be traversed and/or personal preferences. The level of restoring force or restoring torque here determines how high a pressure is exerted on the tips of the ski while lifting the heel in the Telemark step. However, the spring constant of the spring mechanism is preferably chosen such that the restoring force in the Telemark downhill mode generates a torque of at least 15 Nm, preferably of at least 16 Nm, especially preferably of at least 17 Nm, even more preferably of at least 18 Nm, even more preferably of at least 19 Nm, and in particular of at least 20 Nm when the movable section of the forefoot-fixing module rotates or pivots by 35° out of the position in which the heel of the ski boot rests on the support.

In an advantageous further development, the spring mechanism can be switched between at least two preset configurations, in which differing levels of restoring forces or restoring torques are generated for the Telemark downhill mode. According to this further development, the skier can use the above basic setting of the restoring force or restoring torque of the spring mechanism to switch between two already preset restoring forces or restoring torques during operation. For example, while skiing downhill on a prepared piste, during which a high tip pressure is desired, the skier can in this way switch into the configuration with the higher restoring force or higher restoring torque, so as to generate a higher tip pressure. On the other hand, a skier traversing deep snow can switch into the configuration with a lower restoring force or lower restoring torque, so as to generate a lower tip pressure given the same movement, thereby preventing the tip of the ski from "burying" itself in the deep snow.

The spring mechanism preferably has allocated to it a control, with which the spring mechanism can be preloaded to generate the restoring force or restoring torque, or be preloaded while switching between said at least two preset configurations, wherein the control is preferably actuated with the foot. This embodiment is based on the consideration that the different restoring forces/restoring torques are particularly easy to generate by varying the preloading levels of the spring mechanism. If the spring mechanism is not preloaded at all or has been entirely released, for example, the resistance-free or approximately resistance-free climbing or cross-country mode can be realized. At least two different preloading levels can further generate said at least two preset configurations. However, significant forces are required in practice for suitably preloading the spring mechanism. For this reason, it is advantageous to actuate the accompanying control with the foot, since the skier can exert high enough forces comparatively easily with his or her foot, in particular assisted by the ski boot.

In an advantageous further development, the control takes the form of a preloading lever. Using a lever for preloading purposes further reduces the required forces. In an especially advantageous further development, the preloading lever simultaneously serves as a platform for the ski boot. Even a comparatively longer preloading lever can be readily accommodated in this way without making the binding as a whole too voluminous or unwieldy.

The spring mechanism preferably comprises a spring, in particular a compression spring, which preferably is situated under the sole of a ski boot when received in the ski binding. In particular, the spring can be located underneath a platform formed by said preloading lever. This also facilitates a compact structural design, wherein the preloading lever can additionally protect the compression spring against damage, and to a certain extent also against icing by compacted snow.

In an advantageous further development, the preloading lever accommodates an additional lever, which can interact with a section of the spring mechanism in such a way as to convert a rotating motion of the preloading lever into a preloading motion of the spring mechanism. While preloading the spring mechanism, the additional lever preferably runs through a maximum preloading dead point. Until this dead point has been reached, actuating the preloading lever leads to an increase in preloading. Once this dead point has been exceeded, however, the preloading mechanism easily slackens, and the preloading lever is held in this position by the preloading of the spring mechanism. In this embodiment, no additional locking means are then required to fix the spring mechanism into its preloaded position.

In an advantageous further development, the position of the rotational axis of the additional lever can be adjusted by the preloading lever between at least two stable positions, so as to realize said at least two configurations of the spring mechanism.

In an advantageous embodiment, the front and/or rear receptacle comprises at least one claw-like element, which can be moved between an open and closed position. When in its closed position, the claw-like element is suitable for engaging around or engaging into the front end of the ski boot, in particular the front sole extension or said engagement element. Herein, the claw-like element is biased into the closed position. Said release mechanism further exhibits a first cam surface or abutment surface, which is associated with the receptacle, in particular with the claw-like element itself. The first cam surface or abutment surface is designed and situated to interact with a ski-boot-fixed release element in such a way that the claw-like element can be moved into the open position by means of the ski-boot-fixed release element and the first cam surface or abutment surface when the ski boot is rotated in the sole plane. In this embodiment, turning the ski boot thus causes the claw-like element to move into the open position by having the ski-boot-fixed release element and the first cam surface or abutment surface interact with each other. However, since the claw-like element is biased into the closed position, this rotation of the ski boot must take place against the preloading of the claw-shaped element in the closed position. As a result, adjusting the preloading or biasing force of the claw-like element into the closed position makes it possible to set the aforementioned threshold for the torque of the ski boot in relation to the forefoot-fixing module, which when exceeded causes the front section of the ski boot to be released from the forefoot-fixing module. In this way, a reliable release function can be realized with comparatively simple means. This structural design can further be used to realize a so-called "step-in" function, in which the skier simply inserts his or her forefoot into the claw-like element, which is open or opens when entered, and thereby switches the latter into the closed position.

In an advantageous further development, the ski-boot-fixed release element is formed by a portion of said engagement element, in particular by a cam surface or abutment surface provided on the engagement element. Of course, only one cam surface provided on the ski-boot-fixed release element or on the receptacle, in particular on the claw-like element, is necessary to convert the rotating motion of the ski boot into an opening of the claw-like element. While this cam surface can interact with a cam surface of the respective other element, it is in many cases sufficient for this other element to exhibit only one "abutment surface". The "abutment surface" is understood to mean any surface that can interact with the cam surface in the manner described, wherein this abutment surface can in particular also be formed by the tip of a peg, pin or the like, and can essentially be as small as desired.

In an advantageous further development, the front or rear receptacle exhibits two of said claw-like elements, of which a first can be moved into the open position by inwardly rotating the ski boot, and a second by outwardly rotating the ski boot. The torque of the ski boot required for this purpose can be variably adjustable in relation to the forefoot-fixing module for the first and second claw-like elements, in particular so that the torque required to open the first claw-like element is smaller than the torque required to open the second claw-like element. This means that the ski boot releases more easily given an excess inward rotation of the leg, for example in the event of a fall, than during a corresponding outward rotation. Studies in sports physiology have shown that ligament injuries happen more frequently precisely during an inward rotation, because in particular the cruciate ligament apparatus is more sensitive to inward rotation. In this regard, it is advantageous that the binding be released more easily especially during such injury-prone movements.

The asymmetry with respect to the release values can also be effected by varyingly positioned flanks or abutment surfaces of the engagement element fixed in place in the boot.

The claw-like element can preferably pivot between the closed and open position.

In an advantageous further development, the release mechanism comprises a second cam surface or abutment surface, which is associated with the receptacle, in particular with the claw-like element. This second cam surface or abutment surface is configured to interact with the ski-boot-fixed release element in such a way that a force exerted by the ski-boot-fixed engagement element perpendicular to the sole plane supports or counteracts said biasing or preloading force of the claw-like element in the closed position, in particular in such a way that an upward pulling force directed perpendicular to the sole plane counteracts said preloading force of the claw-like element in its closed position. As mentioned at the outset, one problem associated with conventional Telemark bindings is that, the higher the heel is lifted from the ski or the more the knee is bent, the harder it is to release the ski boot from the binding. One special advantage to the structural design according to the invention is that this negative influence on the release behavior so prevalent in prior art can be avoided. According to the embodiment described here, this behavior can instead be reversed, so that a pulling force that is upwardly directed perpendicular to the sole plane, i.e., encountered when the heel lifts in the Telemark step, counteracts said biasing force of the claw-like element into its closed position, and thereby even raises the release sensitivity. It can be ensured in this way that the binding will activate easily in particular in situations where the knee is bent, which are especially susceptible to injury.

The movable section is preferably joined by way of a connecting mechanism with the mounting section of the forefoot-fixing module in such a way that the movable section can be moved in relation to the mounting section so that a pure rotating or pivoting motion overlaps with a translational motion, in order to facilitate a physiologically favorable rolling of the forefoot. Herein, the connecting mechanism can preferably be formed by a roller bearing or mechanical linkage.

The present invention further relates to a ski boot, whose front end, in particular with a front sole extension, can be received in a front receptacle of a ski binding according to one of the embodiments described above, and which has an engagement element on or in its underside or to the side of the sole that is suitable to be received in the rear receptacle of such a ski binding. The ski boot can exhibit a kink fold.

The ski boot preferably comprises a cable mechanism, with which the sole of the ski boot can optionally be stiffened. This makes it possible to give the ski boot a comparatively soft and flexible design, thereby permitting a physiological and energy efficient climbing on flatter terrain.

At the same time, the sole can be partially stiffened by the cable to generate a boot bending resistance favorable for Telemark downhill runs, or completely stiffened to enable an alpine downhill or steep, staircase-like climb without any bending of the sole. Instead of being stiffened by a cable, the sole can alternatively also be stiffened with pressure applied by a suitable element.

The cable mechanism can preferably be actuated by a lever, wherein the lever can be set to a closed position in which the cables of the cable mechanism that run under the sole of the ski boot are tensioned, and can be adjusted to an open position in which the cables underneath the sole of the ski boot are loose or less tensioned.

The ski boot further preferably comprises a boot bending resistance module allowing to set a bending resistance of the ski boot in relation to a bending of its sole. This boot bending resistance module makes it possible to generate a boot bending resistance suitable for Telemark downhill runs in an inherently comparatively flexible ski boot.

In an advantageous further development, the ski boot allows a rotation by the shaft of the ski boot in relation to its bottom part with said lever in an open position, wherein this rotation is blocked in the closed position of the lever. This enables an easy and error-free switching of the ski boot between a rigid position with stiffened sole and fixed shaft and a soft position with flexible sole and rotatable/pivotable shaft by actuating a single lever. However, it is preferably optionally possible to block the shaft of the ski boot in relation to its bottom part with the lever in an open position, for example to permit a Telemark downhill run with a fixed shaft, but flexible sole. For example, in addition to a lever that locks and releases the rotation of the shaft and boot, another lever can also be provided to preload the cable mechanism and hereby activate any boot bending resistance module that might be present. The two levers can be functionally interconnected in such a way that, even though four different modes would theoretically be possible, only the three states that make sense for practical application are allowed, specifically 1) A boot shaft that rotates freely in relation to the bottom part, and a flexible sole, for example when climbing in a flat terrain,
2) A boot shaft locked against rotation in relation to the bottom part of the boot in combination with a flexible sole, for example during Telemark downhill runs in soft snow, and
3) A boot shaft locked against rotation in relation to the bottom part of the boot in combination with a rigid sole, for example during downhill runs on a hard piste or staircase-like climbs in steep terrain.

BRIEF DESCRIPTION OF THE FIGURES

Additional advantages and features of the invention become apparent from the following description, in which the invention is explained in greater detail based on several exemplary embodiments, making reference to the attached drawings. Shown on:

FIGS. 13*a* to 13*c* are perspective views and sectional views of the mounting section of FIG. 12 with different settings of a multifunction cam.

DESCRIPTION OF THE PREFERRED EMBODIMENTS

Figure 1:
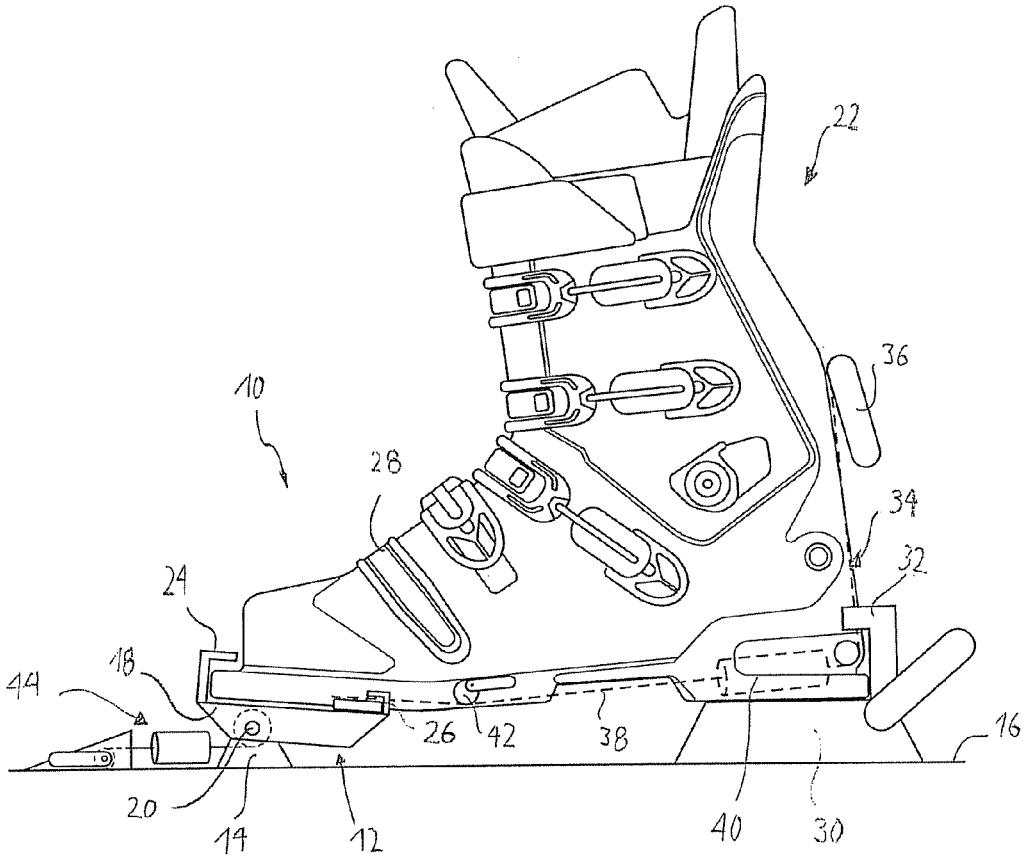
FIG. 1 is a schematic view of a ski binding and ski boot according to an embodiment of the invention, wherein the ski binding is set up for Telemark downhill runs, as well as for alpine downhill runs.

FIG. 1 presents a schematic view of a ski binding 10 according to a preferred embodiment of the present invention. The ski binding 10 comprises a forefoot-fixing module 12 with a mounting section 14, which is mounted to a ski 16, and a movable section 18, which in the exemplary embodiment shown is joined with the mounting section 14 so that it can rotate around a horizontal axis 20.

As depicted on FIG. 1, the forefoot-fixing module 12 is used to fix in place a front section of a ski boot 22. For this purpose, the movable section 18 of the forefoot-fixing module 12 comprises a front receptacle 24 for receiving the front end of the ski boot 22, a front sole extension in the exemplary embodiment shown. The movable section 18 further comprises a rear receptacle 26, which is not specifically discernible on FIG. 1, but will rather be explained in greater detail below. The rear receptacle 26 is suitable for receiving an engagement element (not depicted on FIG. 1) situated on the underside of the sole of the ski boot 22.

In the illustration on FIG. 1, the movable section 18 comprises a rigid plate or a rigid frame, to which the front and rear receptacles 24, 26 are fastened. This means that a front section of the ski boot 22 is "flatly" fixed in place in the forefoot-fixing module 12, without a bending of the corresponding front section of the sole of the ski boot 22 being possible or intended. At the same time, the mobility of the movable section 18 in relation to the mounting section 14 of the forefoot-fixing module 12 allows the front boot section to pivot around the horizontal axis 20. Let it be noted that establishing a connection by way of a pivot joint merely represents a technically especially simple way to have the movable section 18 be able to move in relation to the mounting section 14, but that the invention is not limited to this movement pattern. Instead, it is also possible to configure the movable section 18 so that it can move in relation to the mounting section 14 in such a way as to permit a superposition of rotating and translational movements, which reflects the natural rolling of the forefoot better than a simple rotation around the horizontal axis 20. Nevertheless, the movable section 18 is always movable relative to the mounting section 14 in such a way that this movement comprises a pivoting or rotating component.

As further discernible from FIG. 1, only a comparatively short section in relation to the entire sole length of the ski boot 22 is held by the forefoot-fixing module 12, which typically comprises less than half, in particular less than one third of the sole length of the ski boot 22. In absolute numbers, the length of the section of the sole fixed in the forefoot-fixing module 12 measures less than 15 cm, preferably less than 12 cm, and in particular less than 11.5 cm, and/or more than 4 cm, preferably more than 5 cm, and especially preferably more than 6 cm. In the illustration of FIG. 1, the ski boot 22 has a kink fold 28 of the kind known for conventional Telemark ski boots, and the section of the sole of the ski boot 22 fixed by the forefoot-fixing module 12 lies completely in front of the point of intersection between the kink fold 28 and the ski boot sole. This means that the fixation by the forefoot-fixing module 12 does not impede the bending of the sole of the ski boot 22 provided by the kink fold 28.

The rear receptacle 26 is associated with a release mechanism (not visible in FIG. 1), which causes the front section of the ski boot 22 to be released from the forefoot-fixing module 12 when a threshold has been exceeded by the torque of the ski boot 22 in relation to the forefoot-fixing module 12 corresponding to a rotation by the ski boot 22 in the sole plane. This release mechanism allows the boot 22 to reliably separate from the ski 16 when exposed to an excess load, for example during a fall.

As further evident from FIG. 1, the ski binding 10 comprises a support 30 for the heel of the ski boot 22. The heel element 32 is only depicted schematically, and can be used to fix the heel of the ski boot 22 in place on the support 30 to provide an alpine downhill mode.

Let it be noted that a rigid ski boot sole is as a rule required for an alpine downhill mode, while the sole of the ski boot 22 is flexible, and the ski boot 22 also permits some bending due to the kink fold 28. In the embodiment on FIG. 1, however, the bending stiffness of the ski boot can be adjusted by a system internal to the boot. In the embodiment shown, this is accomplished with a cable mechanism 34, with which the ski boot can be "braced" to increase its bending stiffness. The cable mechanism comprises a lever 36, which when activated makes it possible to tighten the cables 38 running under the boot sole, in order to thereby stiffen the sole. The position of the lever 36 depicted on FIG. 1 corresponds to a state in which the cables 38 are tensioned, so that the sole of the ski boot 22 is stiffened. In the embodiment shown, the lever 36 in this position also locks the shaft of the ski boot 22 so that it cannot rotate/pivot in relation to the bottom part of the boot. The position of the lever 36 depicted is also referred to as the "closed" position in the present disclosure. The ski boot 22 as a whole is thus stiffened in this configuration with a closed lever 36, as preferred for alpine downhill runs.

The lever 36 can also be adjusted to an open position (not shown), in which the shaft is unlocked so that it can rotate in relation to the bottom part of the boot, and in which the tension on the cables 38 is simultaneously relaxed, so that the sole of the ski boot 22 can be bent. However, it is optionally preferably also possible to block the shaft of the ski boot in relation to its bottom part with the lever in the open position, for example to permit a Telemark downhill run with a fixed shaft, but flexible sole, as explained above.

When the cables 38 are completely slack, the bending resistance of the ski boot 22 is given exclusively by its intrinsic flexibility. However, it is also possible to set the bending stiffness of the ski boot 22 with the cable mechanism 34, so that the bending stiffness is higher than the intrinsic bending stiffness of the ski boot itself, but lower than in case of a completely rigid bracing. Provided for this purpose is a boot bending resistance module 40, which generates a bending resistance force that depends on the bending state, and can comprise a spring or a spring system, for example. This boot bending resistance module 40 is used to exert (additional) pressure on the tips of the skis while the boot sole bends in the Telemark step. In conventional Telemark ski boots, the intrinsic bending resistance is rather high, for example as compared with a walking boot, so that it can offer enough bending resistance for the Telemark downhill run, but is often harder than would be desirable for purposes of walking uphill. By contrast, the boot bending resistance module 40 can be used to adjust the bending resistance of the boot to the application. For example, varying bending resistance levels can be prescribed to generate a varying level of tip pressure in the Telemark style, typically a higher tip pressure for downhill runs on a prepared piste and a lower tip pressure for downhill runs in deep snow. In addition, the bending resistance generated by the boot resistance module 40 can be further lowered or raised to enable energy-efficient climbing or cross-country skiing on level terrain. As a result, the intrinsic bending resistance of the boot can be set lower from the very outset than usually the case for conventional Telemark boots, in order to generally optimize the rolling behavior for climbing or skiing on level terrain.

Finally, the cable mechanism 34 comprises an element 42, which when activated can influence the progression of the cable 38, for example by activating an eccentric (not shown). Changing the progression of the cable 38 under the boot sole makes it possible to affect how the bending resistance of the ski boot 22 develops, i.e., how the bending resistance depends on the bending state of the sole, e.g., from linear to progressive. Let it be noted that the Telemark bindings with bottom cables extending under the sole of the boot available on the market often develop a strong, progressive resistance, while the resistance typically develops less progressively or is almost linear for lateral cable bindings. This method known for conventional Telemark bindings can to some extent be reproduced by setting the bending resistance of the boot 22.

Finally, the binding 10 comprises a spring mechanism 44, which is only schematically denoted on FIG. 1. The spring mechanism 44 generates a restoring power, more precisely a restoring torque in the case depicted, between the movable section 18 and the mounting section 14 of the forefoot-fixing module 12, which counteracts a lifting of the rear end of the movable section 18 from the ski, for example while the heel of the ski boot 22 lifts during a Telemark turn. This restoring torque serves to apply pressure on the tips of the ski 16 during the Telemark downhill mode when the heel of the ski boot 22 is lifted from the ski 16. In conventional Telemark bindings, a similar restoring torque is generated by the cable on the one hand, and by the bending moment of the ski boot sole on the other, wherein the front sole extension of the ski boot, which is also referred to as the "beak", is clamped torque-proof in a front portion of the binding, the so-called "toe box". When the heel is lifted, at least the front end of the beak clamped into the toe box essentially remains in its position, so that the sole bends, and deforms in particular in the area of the kink fold. The resultant resistance makes it possible to exert pressure on the ski tips. In addition, the kinematic arrangement of the toe box, cable and heel relative to each other as the boot kinks yields a force in the cable that rises with the buckling angle. In equal measure, this pulling force ensures that the boot fits in the binding, and generates a torque that further builds up the tip pressure.

Let it be noted that the cable necessary for generating the tip pressure at the same time forces the boot more rigidly into the toe box, and thus leads to a more rigid fixation of the boot in the binding, which leads to safety problems given excessive loads, for example during a fall. The release sensitivity of the boot from the binding on the one hand and the resistance generated by the binding to a lifting of the heel required to build up a tip pressure are thus interlinked in conventional Telemark bindings for construction-related reasons. This means that only unsatisfactory compromises can often be arrived at in practice between a reliable release and a desired lifting resistance. This problem is exacerbated even further in practice, since the strongest tension in the cable is generated with the heel lifted or knee bent. Studies in sports medicine have shown that ligament injuries are encountered precisely in falls involving a bent knee, i.e., that having the boot be easily released from the binding would be especially desired with the knee in a bent state. By contrast, the tension in the cable is especially high when the knee is bent in conventional Telemark bindings, so that it becomes more difficult to release the boot from the binding, thereby increasing the risk of injury.

By contrast, the fixation of the boot 22, more precisely of a front section of the boot 22, in the forefoot-fixing module 12 of the ski binding 10 on FIG. 1 is completely decoupled from the spring mechanism 44, which generates a restoring force when the heel of the ski boot 22 is lifted. As a consequence, the fixation of the forefoot in the forefoot-fixing module 12 can be designed with the focus solely on safety aspects, without having to make compromises with respect to an adequate restoring power. At the same time, the spring mechanism 44 offers additional degrees of freedom in the adjustment process, but also with respect to varying the restoring force during operation, which will become more apparent from the following description.

The spring mechanism 44 can be deactivated, so that the movable section 18 can also be rotated or pivoted without a restoring torque, which then allows an energy efficient walking on flat terrain, or an energy efficient ascent with climbing skins under the ski 16.

The variant of the ski binding 10 depicted on FIG. 1 thus allows three operating modes, namely:

A Telemark downhill mode, in which the heel element 32 is open, so that the heel of the ski boot 22 can be lifted from the heel support 30, but the spring mechanism 44 is activated to generate a desired restoring moment as the heel is lifted, with which pressure can be exerted on the ski tip, A cross-country or climbing mode, which corresponds to the Telemark downhill mode, the only difference being that the spring mechanism 44 is deactivated, so that the heel of the ski boot 22 can be lifted from the heel support 30 without any appreciable resistance, and An alpine downhill mode, in which the heel of the ski boot 22 is fastened to the heel support 30 by means of the heel element 32. This alpine downhill mode is shown on FIG. 1.

As a consequence, the ski binding 10 in the embodiment shown on FIG. 1 combines the functionalities of conventional ski tour bindings and conventional Telemark bindings. In particular, it permits an improved climbing and above all an improved striding with skiers 16 over a flat terrain by comparison to conventional ski touring bindings intended for use with ski boots having a stiff sole, because it supports the use of ski boots having a flexible sole that permit the foot to at least partially roll. At the same time, it allows a release behavior during falls that is similarly reliable to that of ski touring bindings having a foot plate.

In comparison to a conventional Telemark binding, the Telemark binding on FIG. 1 is characterized by an improved release behavior, which in particular can be set without regard to generating a specific section modulus resistance during Telemark downhill runs, and is essentially independent of how the foot is positioned or the knee is bent, or even allows an easier release with the knee bent, as explained in greater detail below. At the same time, the section modulus can also be set more easily and flexibly, because no attention has to be paid to whether the boot is fastened well enough in the binding, as is generally the case for cable bindings.

A special advantage in the ski binding 10 on FIG. 1 lies in the fact that it permits both the Telemark and alpine downhill modes. Many skiers and ski tourers versed in the alpine downhill style would indeed be interested in occasionally embarking on a ski tour in the Telemark mode, in particular on easy piste sections or on simple terrain, but are put off by the costs for a second set of equipment, or do not want to be overtaxed on difficult terrain by the Telemark style. With the binding 10 on FIG. 1, skiers like these can switch to the more familiar alpine downhill mode at any time.

Figure 2:
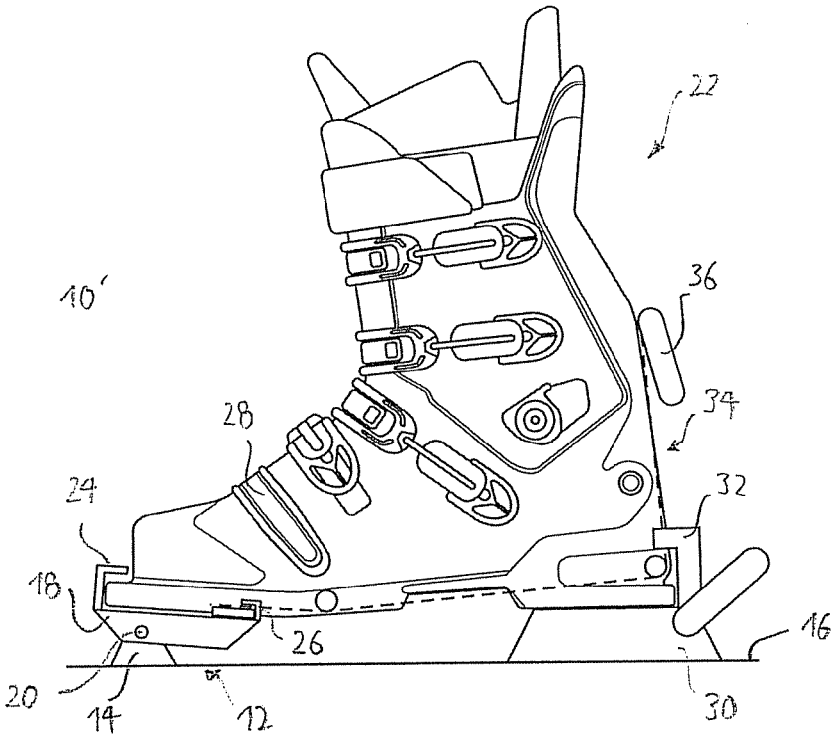
FIG. 2 is a schematic view of a ski binding according to a further development of the invention, which is designed only as a ski touring binding.
Figure 3:
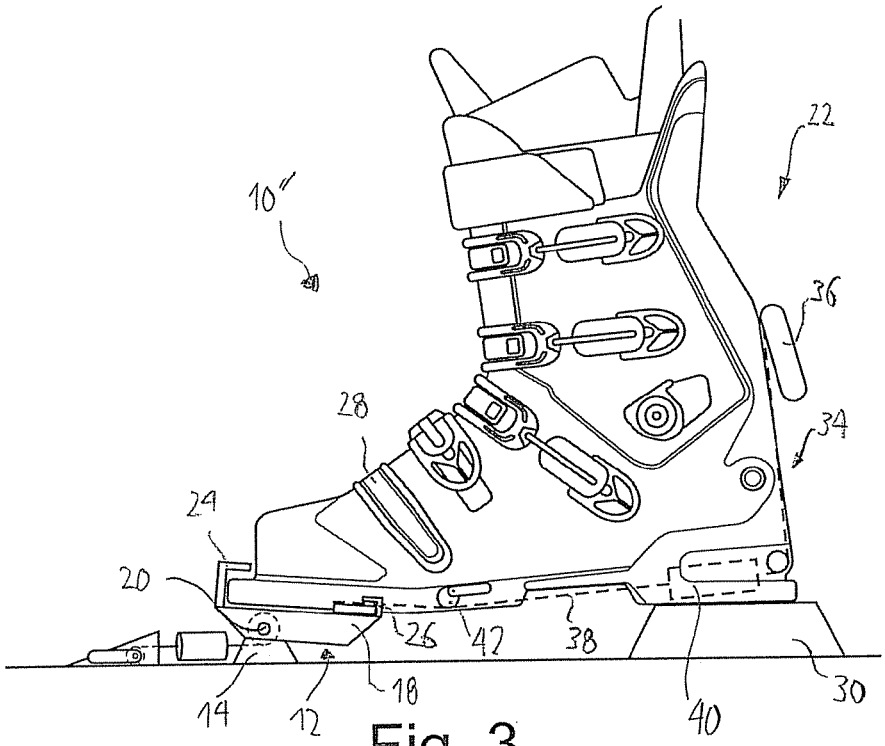
FIG. 3 is a schematic view of a ski binding according to a further development of the invention, which is designed as a pure Telemark binding.

At the same time, let it be acknowledged that the ski binding 10 in the form shown on FIG. 1 already offers significant advantages over conventional ski tour bindings or Telemark bindings both with respect to their functionality as a pure ski tour binding, and with respect to their functionality as a pure Telemark binding. In this regard, it makes sense to alternatively design the ski binding 10 on FIG. 1 as a pure ski tour binding 10', which omits the spring mechanism 44 required only for the Telemark downhill mode. This variant is depicted on FIG. 2. Conversely, the heel element 32 can be omitted to create a pure Telemark binding. Such a variant is shown on FIG. 3 with reference number 10". In both cases, however, use is made of the same forefoot-fixing module 12 and the same heel support 30. In other words, the present invention allows a modular structure for a ski binding, which by combining inherently identical components in different ways can be configured as a pure ski tour binding, as a pure Telemark binding, or as a combined ski tour-Telemark binding, which would be especially suited for ski hiking, which is very popular in Scandinavia.

Finally, the ski binding according to the invention can also be designed as a cross-country binding, which contains neither the spring mechanism 44 (or a spring mechanism 44 weakened for purposes of cross-country skiing) nor a heel element 32. This makes it possible to obtain a cross-country binding that is safer than conventional cross-country bindings in terms of injury, since use is made of the release function of the forefoot-fixing module 12.

Figure 4:
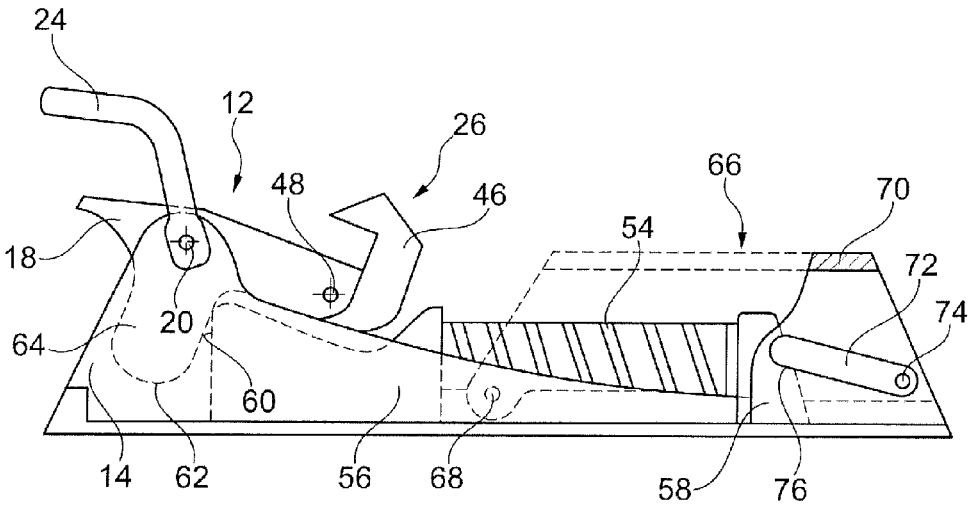
FIG. 4 is a schematic side view of a forefoot-fixing module and a spring mechanism.

FIG. 4 provides a more detailed view of a forefoot-fixing module 12 and spring mechanism 44. The same reference numbers here denote identical features from different figures.

In the embodiment on FIG. 4, the forefoot-fixing module 12 also comprises a mounting section 14 and a movable section 18, which is secured to the mounting section 14 so that it can rotate around a horizontal axis 20. The movable section 18 of the forefoot-fixing element 12 comprises a front receptacle 24, which in the exemplary embodiment on FIG. 4 consists of a bracket that can engage around a front sole extension of a ski boot (not shown). The movable section 18 further comprises a rear receptacle 26, which has at least one claw-like element 46 that is hinged to the movable section 18 so that it can rotate or pivot around an additional horizontal axis 48. A preloading mechanism (not shown) biases the claw-like element 46 into a closed position depicted on FIG. 4. In this closed position, it can engage around an engagement element (not shown), which is attached to or in the underside or to the side of the sole of an accompanying ski boot. An actuating mechanism (not shown) can be used to switch the claw-like element 46 into an open position, in which the engagement element (not shown) is released. For example, this mechanism can be activated by means of a hand pull (not shown).

The preloading mechanism of the claw-like element 46 has a bistable configuration, in which the claw-like element 46 passes through a metastable position while being switched into the open position against the preloading force, and snaps into the open position (not shown) after surmounting the metastable position. As an alternative, the preloading mechanism of the claw-like element 46 can be designed in such a way that it only opens upon entering into the binding.

Figure 5A:
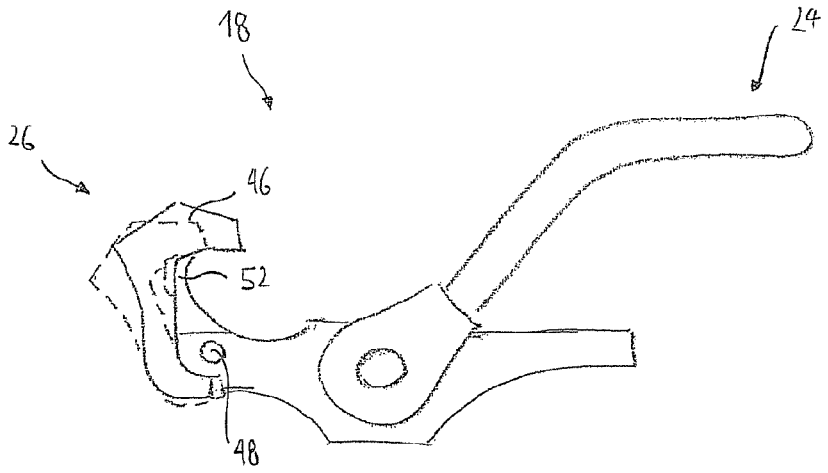
FIG. 5*a* is a side view of a movable part of a forefoot-fixing module.
Figure 5B:
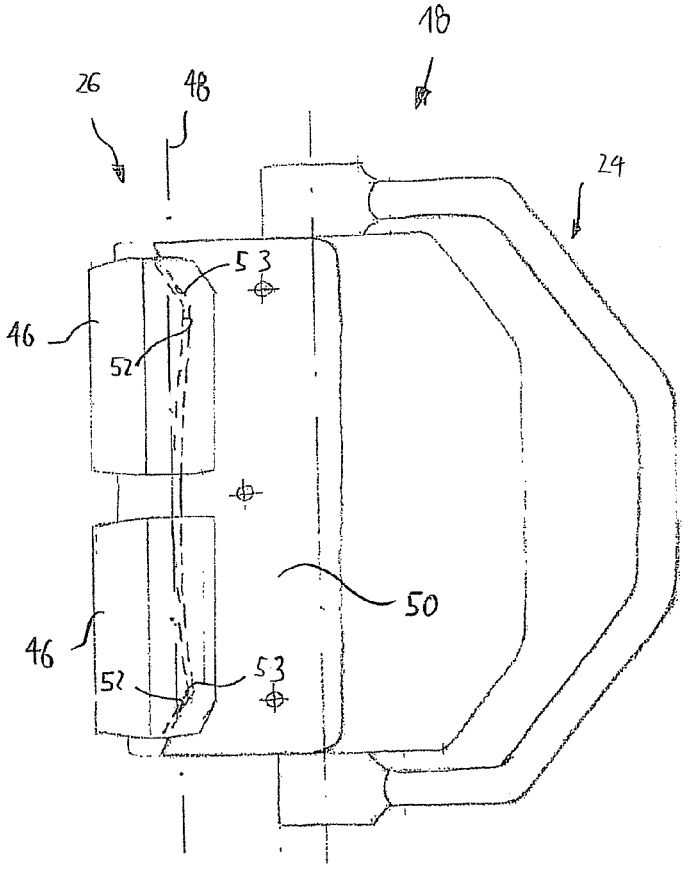
FIG. 5*b* is a top view of the movable part of the forefoot-fixing module of FIG. 5*a*.
Figure 5C:
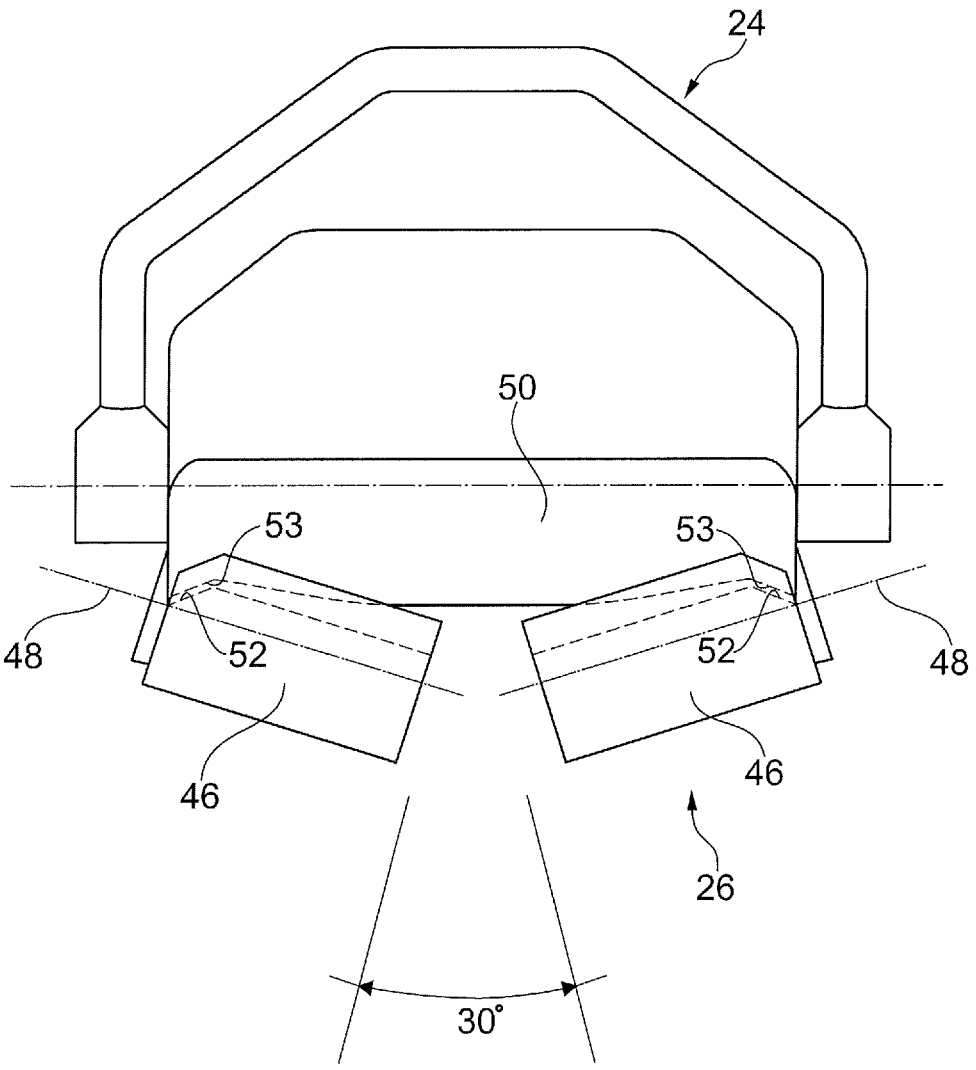
FIG. 5*c* is a top view of a movable part of a forefoot-fixing module.

Two adjacent claw-like elements 46 of the kind depicted on FIGS. 5*a*, 5*b* and 5*c* can also be provided instead of one claw-like element 46. FIG. 5*a* is a side view depicting a movable part 18 of a forefoot-fixing element 12, which shows a front receptacle 24 in the form of a bracket, and a rear section in the form of two adjacent claw-like elements 46. FIG. 5*b* shows a corresponding top view, which also depicts an engagement element 50 to be secured to a ski boot, which is engaged around by the two claw-like elements 46 in their closed position. The dashed lines on FIG. 5*a* further illustrate the open position of the claw-like elements 46.

As evident in particular from FIGS. 5*a* and 5*b*, the claw-like elements 46 have a cam surface 52, which is covered on FIG. 5*b* and thus drawn in dashed lines, and lies opposite a cam surface 53 of the engagement element 50. When a ski boot is rotated in its sole plane in relation to the movable part 18 of the forefoot-fixing element 12, the engagement element 50 secured to its sole also turns. For example, if the engagement element 50 in the illustration on FIG. 5*b* turns counterclockwise, the cam surface 53 of the engagement element 50 pushes the cam surface 52 of the claw-like element 46 at the top in the illustration on FIG. 5*b* against the biasing force of the claw-like element 46 and into the open position. In this way, the engagement element 50, and hence the ski boot, is released once the torque has exceeded a predetermined threshold. This threshold can be set via the preloading force of the claw-like element 46, and can be adjusted to the body weight and skiing ability of the skier in such a way that the ski boot is reliably released from the binding when the leg of the skier is twisted in a manner susceptible to injury, e.g., during a fall.

By contrast, when turning the engagement element 50 clockwise, the cam surface 52 of the lower claw-like element 46 is pushed by the cam surface 53 of the engagement element 50, so that the claw-like element 46 at the bottom in the illustration on FIG. 5*b* can be switched to the open position given a sufficient torque. Opening one of the two claw-like elements 46 is enough to release the ski boot in its entirety. Let it be noted that the preloading forces of the two claw-like elements 46 can be set independently of each other, so that the release torque can be adjusted as a function of direction. Studies in sports medicine have shown that ligament injuries are encountered in particular when a ski rotates inwardly relative to the body, and hence the knee. In this case, it thus makes sense to select a preloading force for the claw-like element 46 to be opened during an inward rotation that is smaller than for the other claw-like element 46.

FIG. 5*c* shows a modification of the rear receptacle 26, in which the two claw-like elements 46 are not coaxially aligned relative to their rotational axes 48, but the rotational axes 48 are instead tilted by 30° in relation to each other. This arrangement is associated with an especially advantageous release behavior.

The claw-like elements 46 permit a so-called "step-in function", in which the claw-like element 46 is closed when the engagement element 50 is treaded into the open claw-like element 46 from above.

As evident when referring back to FIG. 4 again, the spring mechanism 44 comprises a compression spring 54, which is clamped between a front spring stop 56 and a rear spring stop 58. Both the front and rear spring stops 56, 58 are adjustable, so that the compression spring 54 can be correspondingly preloaded or released. The front end of the front spring stop 56 has a cam surface 60, which interacts with a cam surface 62 on an extension 64 of the movable section 18. When the movable section 18 in the illustration on FIG. 4 is moved counterclockwise around the horizontal axis 20, the cam surface 62 of the extension 64 of the movable section 18 pushes the front spring stop 56 by way of its cam surface 60 toward the right in the illustration on FIG. 4, thereby compressing the compression spring 54. In this way, turning the movable section 18 around the horizontal axis 20 generates a restoring torque, the dependence of which on the rotational angle can be exactly prescribed as desired by the shaping of the cam surfaces 60, 62. Let it be noted that this restoring torque produces at least part of the pressure exerted on the tips of the ski when a skier lifts the heel in the Telemark stride, and thereby turns the movable section 18 in the illustration on FIG. 4 counterclockwise. In this regard, the shaping of the cam surfaces 60, 62 makes it possible to freely and ideally preset a tip pressure (corresponding to the leg motion). Note that the term "spring mechanism" must be broadly interpreted, and is not intended to imply any limitations whatsoever as to the type or shape of the element involved in generating the restoring force. The spring mechanism can further also encompass a damping element or the like.

The spring mechanism 44 further comprises a preloading lever 66, which is hinged to the mounting section 14 so that it can pivot around an additional horizontal axis 68. The preloading lever 66 has an approximately (inversely) U-shaped cross section, and thus forms a hollow space in which the compression spring 54 is accommodated. In order to visualize the compression spring 54, the preloading lever 66 depicted on FIG. 4 is partially broken open. On the upper side, the preloading lever 66 forms a platform 70 for a ski boot when the preloading lever 66 is in the folded down position shown on FIG. 4.

Situated at a rear end of the preloading lever 66 is an additional lever 72, which is hinged to the preloading lever 66 so that it can pivot around an additional horizontal axis 74. The additional lever 72 engages into a recess 76 in the rear end of the rear spring stop 58. In order to preload the compression spring 54, the preloading lever 66 is first brought into a starting position, which is turned counterclockwise by about 30° relative to the position shown on FIG. 4, i.e., in which the preloading lever 66 is "folded up" by about 30° around the horizontal axis 68. In this position, the end of the additional lever 72 is inserted into the recess 76 in the rear spring stop 58. The preloading lever 66 is then folded down, preferably depressed, wherein the rear spring stop 58 is pushed to the left with the additional lever 72, against the preloading force of the compression spring 54. Maximum preloading is reached shortly before the preloading lever 66 reaches the position depicted on FIG. 4, i.e., the "folded down" position, i.e. when the additional lever 72 is horizontally situated. The compression spring 54 slackens a bit beyond this position, so that the preloading force of the compression spring 54 holds the preloading lever 66 in the completely folded down position. The comparatively high preloading force required to preload the compression spring 54 can be readily applied due to the geometry of the preloading lever 66, and by virtue of the fact that it can be foot operated.

Figure 6:
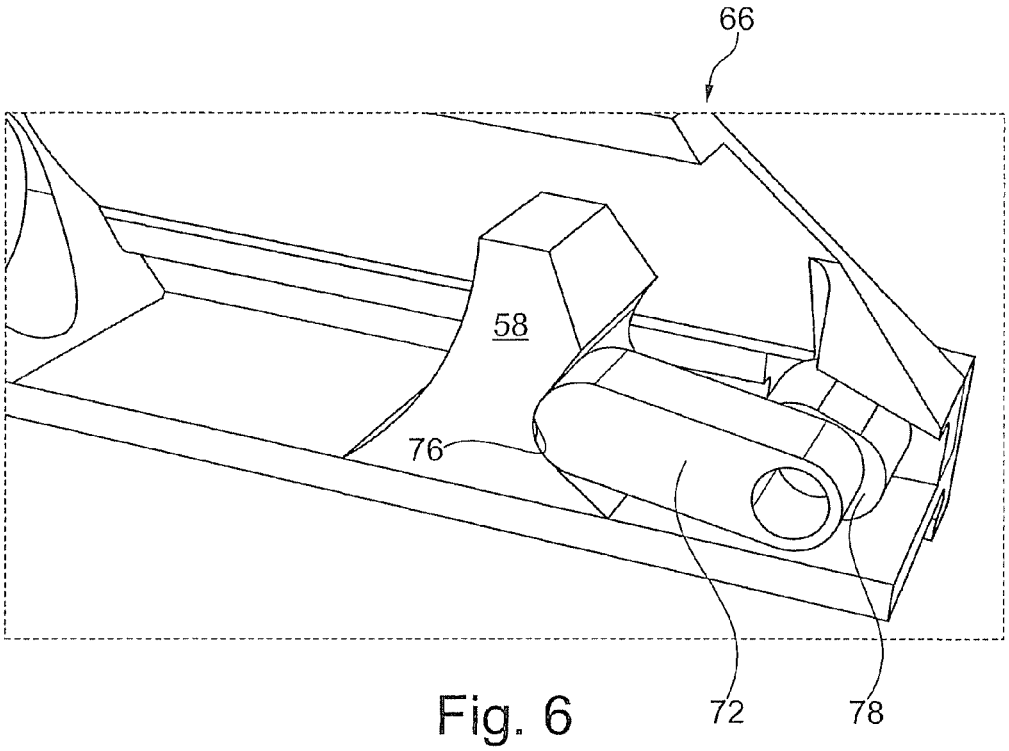
FIG. 6 is a perspective, partially cropped view of a rear spring stop, a preloading lever and an additional lever hinged thereto.

FIG. 6 presents a somewhat more detailed, perspective and partially cropped view of the rear spring stop 58, the preloading lever 66 along with the additional lever 72 hinged thereto. As evident from FIG. 6, the additional lever 62 is joined with the preloading lever 66 by an eccentric element 78. For this reason, the position of the rotational axis 74 of the additional lever 72 can be adjusted in the longitudinal direction of the ski binding 10 by turning the eccentric element 78. The embodiment shown on FIGS. 4 and 6 provides two positions for the rotational axis 74 of the additional lever 72, which impart two preloads of varying strength to the compression spring 54. The stronger of the two preloads yields a higher restoring torque, while the lower preload yields a lower restoring torque for the Telemark downhill mode. For example, a higher restoring torque may be desirable for a downhill run on a prepared piste, while a somewhat lower restoring torque is advantageous for Telemark downhill runs in deep snow, so that the tips do not become buried in the deep snow owing to excess pressure. Herein, it is crucial that these two preloading configurations be preset, and that the skier can switch comparatively easily between these two configurations (even on the piste).

Let it be noted that the additional lever 72 in the illustration on FIG. 4 can also be turned clockwise, so that it no longer engages into the recess 76 in the rear spring stop 58. In this case, the rear spring stop 58 can be pushed toward the back unimpeded, i.e., to the right in the illustration on FIG. 4, so that the compression spring 54 can relax, and no restoring torque is generated relative to the pivoting of the movable part 18 of the forefoot-fixing element 12. This realizes a cross-country or climbing mode in which the tip of the foot can be turned around the horizontal axis 20 with practically no resistance.

The base load of the compression springs 54 can be preset independently of setting the two Telemark downhill modes via the displacement of the rotational axis 74 of the additional lever 72, for example by increasing the length of a spacer (not shown) between one end of the compression spring 54 and the front or rear spring stop 56, 58, or by having the additional lever 72 exhibit an adjustable length, for example in the form of a push rod designed with a left/right-handed thread. For example, this presetting step can be performed at the ski workshop, so as to adjust the base load of the compression spring 54 with respect to the physical constitution of the skier, such as height, weight, leverage ratios, force, etc., the type and length of the ski, skiing ability, and/or subjective preferences. This basic setting is typically not changed during the ski tour or ski day. Only for purposes of adjustment to the prevailing conditions, in particular to the snow conditions, a selection can be made between two different, preset restoring torques through the activation of the eccentric element 78 on FIG. 6 and an accompanying displacement of the rotational axis 74 of the additional lever 72.

Figure 7:
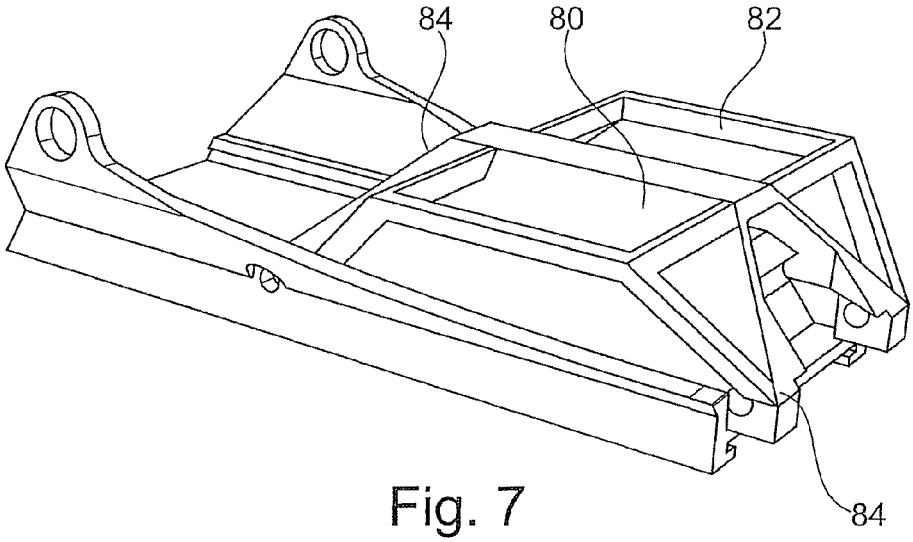
FIGS. 7 and 8 are perspective views of a mounting section of a forefoot-fixing module and a preloading lever.
Figure 8:
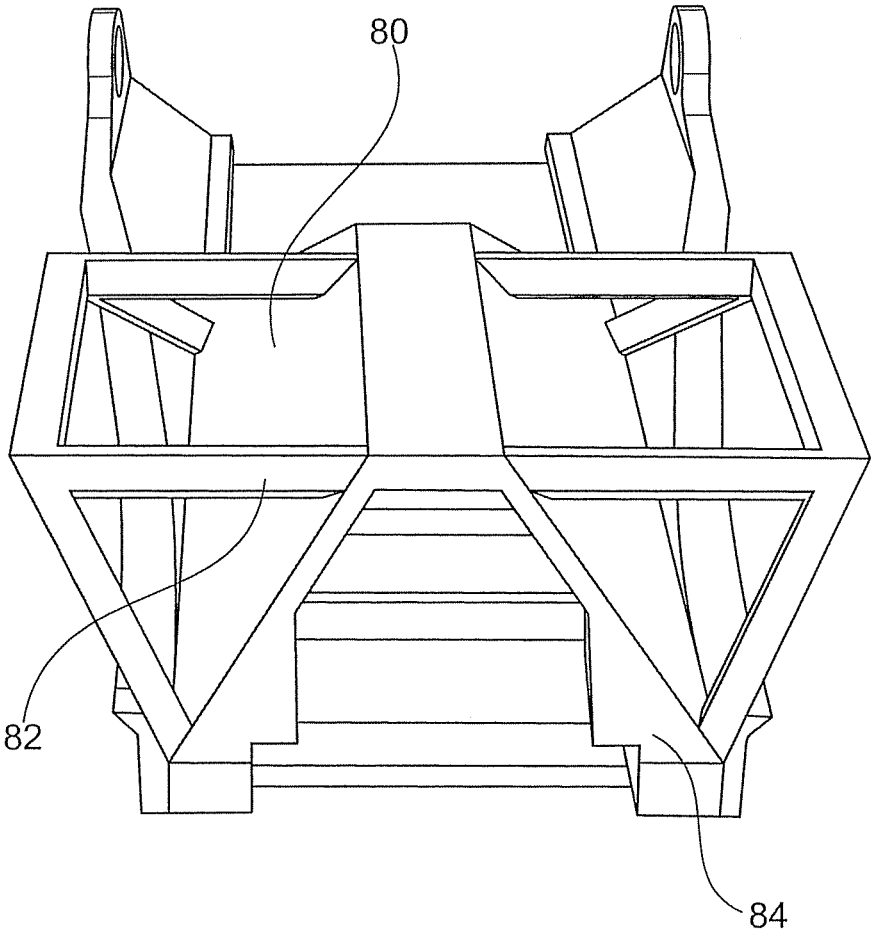

FIGS. 7 and 8 show perspective views of another embodiment of the mounting section 14 of the forefoot-fixing module 12 and preloading lever 66 in a more detailed illustration. As evident in the illustration on FIGS. 7 and 8, the preloading lever 66 has a (n inversely) V-shaped profile 80, which is connected with a frame 82 to generate a wide enough platform for the ski boot. Apart from the beveled lateral surfaces, the preloading lever 66 in this embodiment also has beveled front and rear end surfaces 84. In this configuration, the preloading lever 66 effectively protects the compression springs 54 against snow and ice, wherein the beveled surfaces in particular act as a kind of clearing blade for the snow, and also help force any snow that accumulates on the binding out of the binding in the next downhill motion of the boot; this is especially important while skiing backwards, during which other bindings become clogged with snow. In particular, this makes it possible to prevent snow and ice from impairing the function of the compression springs 54. However, the preloading lever 66 otherwise functions as described in conjunction with FIGS. 4 and 6.

Figure 9:
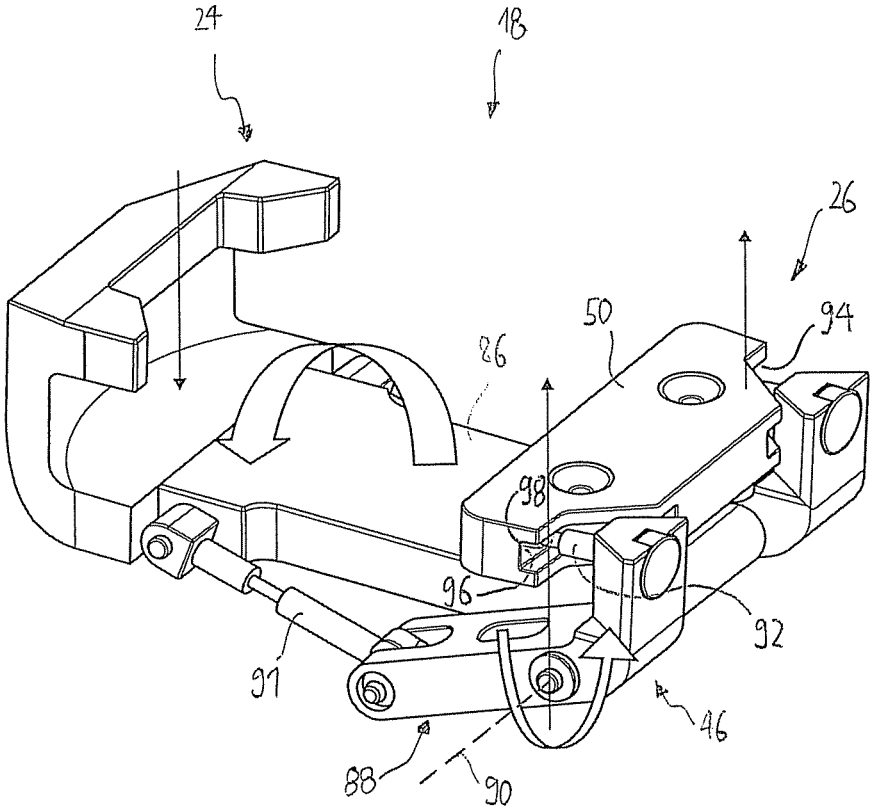
FIG. 9 is a perspective view of another embodiment for a movable section of a forefoot-fixing module (including a boot-fixed engagement element depicted herein)

FIG. 9 shows a perspective view of another embodiment of a movable section 18 of a forefoot-fixing module 12. The movable section 18 comprises a rigid base plate 86, whose front end has a front receptacle 24 for the front sole extension of a ski boot (not depicted). As an alternative, use could again be made of the bracket employed in the above embodiment, so as to make the system utilizable for different boot standards. The rear end of the base plate 86 is provided with a rear receptacle 26, which is made up of two claw-like elements 46. In this case, the claw-like elements 46 consist of angled levers 88, which are hinged to the base plate 86 so that they can rotate around a horizontal axis 90. Provided at the upper ends of the angled levers 88 in the illustration on FIG. 9 is a respective peg or pin 92, which is intended to engage into a groove-like recess 94 of an engagement element 50, which is to be fastened to the underside of a ski boot (not shown on FIG. 9), similarly to the engagement element 50 on FIG. 5*b*.

FIG. 9 shows the claw-like elements 46 of the rear receptacle 26 in a closed position, in which the angled levers 88 are preloaded counterclockwise around the horizontal axis 90 by the spring force of a spring element 91, as a result of which a ski boot is held in the movable part 18 of the forefoot-fixing module 12 by the engagement element 50 fastened thereto.

A cam surface 96 is formed in the groove-like recess 94. As the fixed ski boot turns, the ends 98 of the pins 92 slide along the cam surface 96 of the engagement element 50, thereby turning the two claw-like elements 46 in the illustration on FIG. 9 clockwise around the horizontal axis 90.

The extent to which the individual claw-like elements 46 in the illustration on FIG. 9 rotate here depends on the rotational direction of the boot around its vertical axis. As soon as this rotation exceeds a position in which the longer section of the respective angled lever 88 aligns with the spring element 91, the action of the spring 91 is reversed, i.e., the claw-like element 46 is then turned clockwise by the force of the spring 91, i.e., into an open position in which the engagement element 50 is released. As a consequence, the claw-like elements 46 have a bistable configuration here as well.

The tip or end 98 of each pin 92 forms an "abutment surface", whose function is similar to that of the cam surface 52 of the claw-like element 46 on FIGS. 5*a* and 5*b*. The person skilled in the art recognizes that, for a claw-like element 46 to interact with the engagement element 50, it is sufficient that one of these elements exhibit a cam surface in the narrower sense, and the other an unspecific abutment element.

Similarly to the embodiment on FIGS. 5*a* to 5*c*, the claw-like elements 46 are here intrinsically independent of each other, so that the respective preloading of the spring element 91 can be varyingly adjusted. As a result, the release torque for an inward rotation can again be made less than for an outward rotation of the ski boot.

Let it further be noted that in the closed illustration depicted on FIG. 9, the abutment surface formed by the tip or the end 98 of the respective pin 92 lies vertically over the rotational axis 90 of the claw-like elements 46. This means that a vertical pull on the engagement element 50 in the illustration on FIG. 9 exerts no torque on the angled lever 88 of the claw-like elements 46, and thus has no influence on the release function of the rear receptacle 26. Note that such a vertical pull arises in particular when the skier lifts the heel of the ski boot against the restoring torque of the spring mechanism 44 during a Telemark downhill run. In conventional Telemark bindings, in which the cable is used both to fix the boot in place in the binding and to generate the restoring torque, the increased cable pull also increases the fixation with the knee bent and heel lifted, making it harder to release the boot from the binding. This is disadvantageous, since ligament injuries are observed precisely in situations involving a bent knee.

By contrast, the release behavior of the rear receptacle 26 is independent of a vertical pull on the engagement element 50. However, the structural design on FIG. 9 can also be used to reduce the release torque for situations in which the heel is lifted. As opposed to the illustration on FIG. 9, the length of the pins 92 could for this purpose be increased, so that the point at which the pins 92 engage into the groove-like recess 94 of the engagement element 50 in the illustration on FIG. 9 lies to the left of the vertical plane. In this case, a vertical pull on the engagement element 50 of the kind encountered during a Telemark turn with the knee bent and heel lifted generates a torque on the angled lever 88 via the groove-like recess 94 and underside of the pin 92, which has a clockwise action, i.e., counteracts the preloading force of the spring 91 in this situation. This means that the rear receptacle 26 is more easily released in this especially injury-prone situation. The underside of the pin 92 here forms a "second abutment surface" in the sense of the present disclosure.

Figures 10A, 10B, 10C:
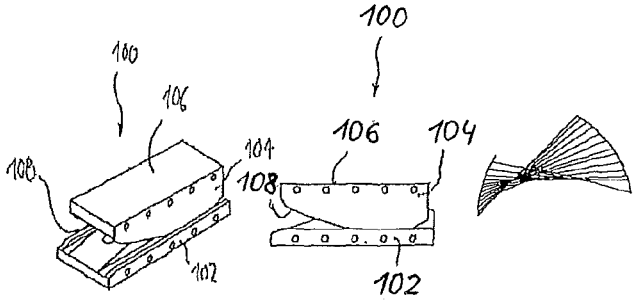
FIGS. 10*a* and 10*b* is a perspective view and side view of rolling kinematics respectively.
FIG. 10*c* is an array of lines representing the motion of rolling kinematics on FIGS. 10*a* and 10*b*.

In the embodiments shown above, the movable section 18 of the forefoot-fixing module 12 is always hinged to the mounting section 14 so that it can rotate around a horizontal axis 20. Combined with a flexible sole of the ski boot 22, this already permits a comfortable and energy efficient stride, especially over flat terrain, for example where ski touring with a stiff sole forces a comparatively non-physiological gait. However, it is possible within the framework of the invention to further improve the mobility between the movable section 18 and the mounting section 14, so as to superpose another translational or rolling motion onto an essentially present pivoting or rotational motion, so that the resulting motion better corresponds to a natural rolling movement of the foot. FIG. 10 shows corresponding connecting mechanisms. FIGS. 10*a* and 10*b* provide a perspective view or side view of a roller bearing or "rolling kinematics" 100. The rolling kinematics 100 have a lower part 102, which can be part of the mounting section 14 of a forefoot-fixing module 12, and an upper part 104, which can be a constituent of the movable section 18 of the forefoot-fixing module 12. The upper part 104 has an upper surface 106, onto which can be mounted a front and rear receptacle 24, 26 of the kinds described above.

Provided on the underside of the upper part 104 are rolling surfaces 108, which accommodate a natural rolling motion of the forefoot. In particular, the rolling kinematics 100 on FIGS. 10*a* and 10*b* make it possible to position the foot starting with the heel at a lower level. FIG. 10*c* depicts an array of lines that show the positions of the upper surface 106 during the rolling motion. As evident from the latter, the movement involves not just a pure pivoting motion of the upper surface 106, but rather a rolling motion, albeit one also having a rotational component.

Figures 10D, 10E, 10F:
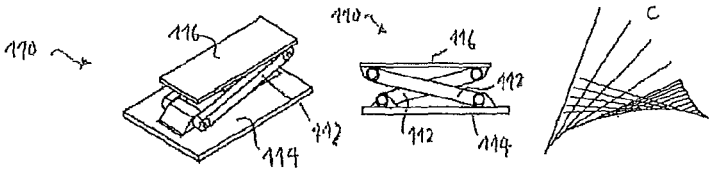
FIGS. 10*d* and 10*e* is a perspective view and side view of a mechanical linkage respectively.
FIG. 10*f* is an array of lines representing the motion of the mechanical linkage on FIGS. 10*d* and 10*e*.

FIGS. 10*d* and 10*e* present a diagrammatic illustration of a mechanical linkage 110. The mechanical linkage 110 comprises two pairs of levers or links 112, which are each hinged at one end to a lower plate 114, and at the other end to an upper plate 116. The lower plate 114 can here be part of the mounting section 14, while the upper plate 116 can be part of the movable section 18 of a forefoot-fixing module 12. The depicted configuration and dimensions of the links 112 yield a pattern of motion for the upper plate 116 relative to the lower plate 114 shown in an array of curves on FIG. 10*f*. Here as well, the foot can be positioned starting with the heel at a lower level during placement. The resultant motion again involves a superposing of rotation and translation, which better reflects the physiological conditions while striding than a purely rotational motion. The rotational portion of the motion here relates to a virtual fulcrum, i.e., not to an actually present individual pivot joint.

Figure 11:
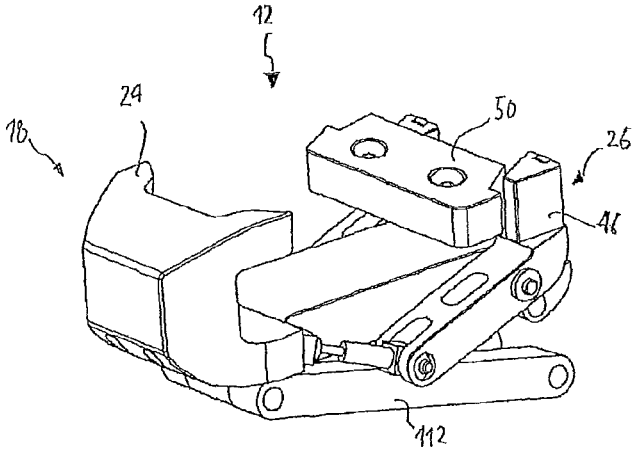
FIG. 11 is a perspective view of a mechanical linkage, on which a front and rear receptacle is mounted.

A front and rear receptacle 24, 26 can also be mounted on the upper plate 116, as shown on FIG. 11 in a perspective view.

As evident from the preceding description, one essential aspect of the inventive ski binding lies in the fact that a spring mechanism is used to generate a restoring force, in particular a restoring torque, between the movable section 18 and the mounting section 14 of the forefoot-fixing module 12, which counteracts a lifting of the rear end of the movable section 18 of the forefoot-fixing module 12 from the ski. This can be achieved in an especially practical manner with a compression spring 54, which is situated between a front and rear spring stop 56, 58, wherein, during operation, the position of the rear spring stop 58 is fixed in place relative to the mounting section 14, and the movable section 18 of the forefoot-fixing module 12 interacts with the front spring stop 56 in such a way that the front spring stop 56 is pushed toward the back against the preloading of the compression spring 54 when the rear end of the movable section 18 of the forefoot-fixing module 12 is lifted, i.e., moved away from the ski. As explained in conjunction with FIG. 4, this interaction between the movable section 18 of the forefoot-fixing module 12 and front spring stop 56 can be induced by suitable cam surfaces 60 and 62, whose geometric configuration then also makes it possible to set the restoring force as a function of the rotational angle of the movable section 18 of the forefoot-fixing module 12.

While the position of the rear spring stop 58 during operation basically remains unchanged in relation to the mounting section 14 of the forefoot-fixing module 12, i.e., does not move as the ski boot is raised and lowered, the position of the rear spring stop 58 can nevertheless be set, so as to generate a desired preloading or restoring force. One example relating thereto was described in conjunction with the embodiment on FIG. 4, in which the position of the rear spring stop 58 can be prescribed by the setting of the eccentric element 78 to generate preloads of varying strength. The rear spring stop 58 can further also be "released", so that it forms no abutment for the compression spring 54 whatsoever, which then permits a virtually resistance-free rotation or pivoting by the movable section 18 of the forefoot-fixing module 12.

In the embodiment shown on FIG. 4, the preloading lever 66 in conjunction with the additional lever 72 is used to bring the rear spring stop 58 into the desired position, which on its part defines the level of preloading, and hence the restoring force or restoring torque. Let it be noted that in the present disclosure "preloading" can also be understood to include situations in which the compression spring 54 is still completely slackened when the rear end of the movable section 18 is situated in its deepest position, i.e., the heel of a ski boot held in the ski binding rests on the heel support 30, and the spring 54 is only tensioned when the heel is lifted. However, the preloading lever 66 represents only one option for bringing the rear spring stop 58 into the desired position, while the invention is by no means limited hereto, and other realizations are possible.

Instead of the preloading lever 66 and the additional lever 72 from FIG. 4, with which the rear spring stop 58 is pushed into the desired position, a comparatively simple realization utilizes one or more tension elements, which can be used to pull the rear spring stop 58 into the desired position. This tension element can be arranged parallel, in particular coaxial, to the spring element 54, which permits an especially compact structural design. The tension element(s) here preferably act(s) in conjunction with an actuating element, which engages a front section, in particular the front end of the tension element, and allows to shift the front end of the tension element in the longitudinal direction of the ski binding to thereby set the position of the rear spring stop 58.

Figure 12:
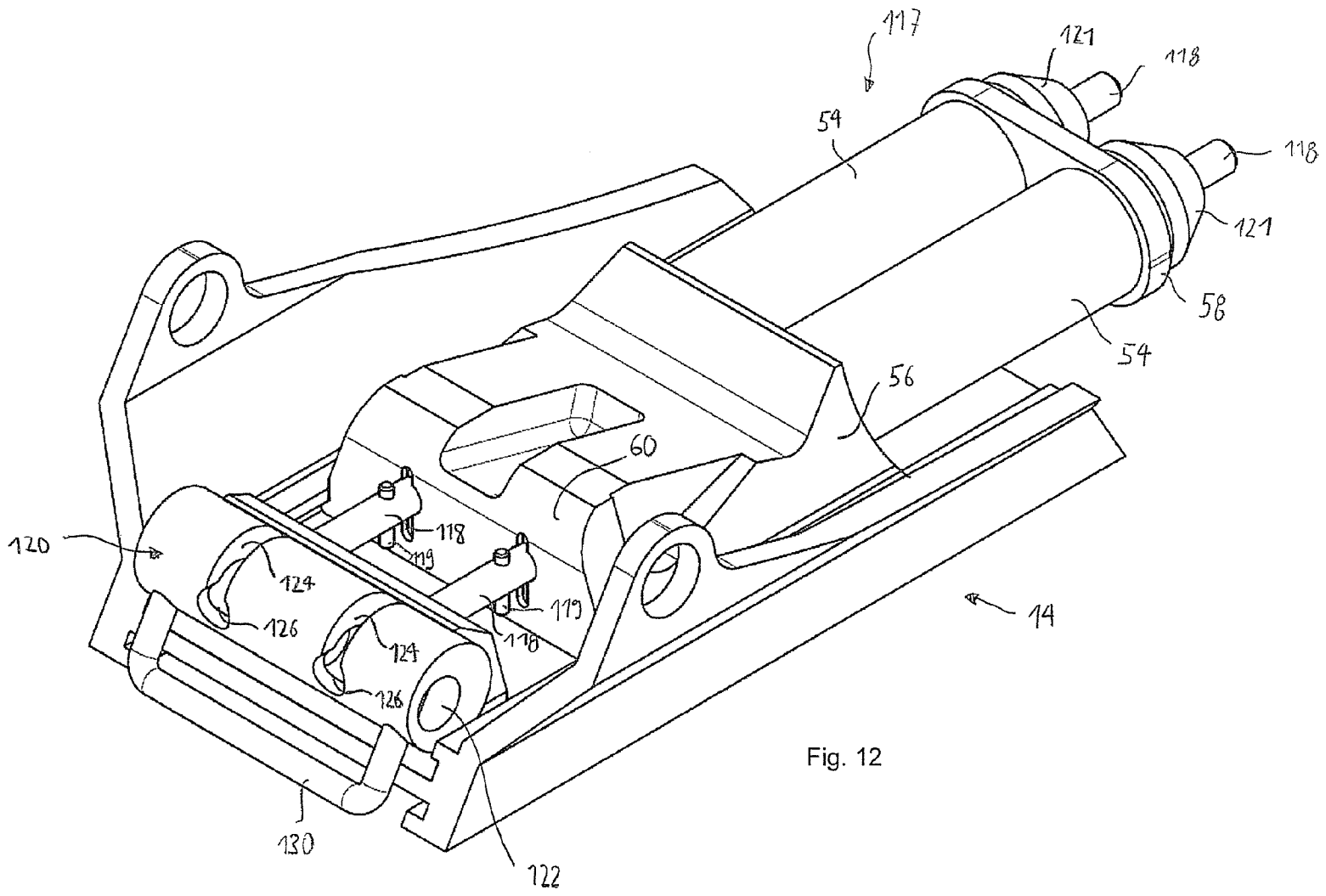
FIG. 12 is a perspective view of a mounting section of a forefoot-fixing module according to another embodiment.

FIGS. 12 and 13 show an example for a ski binding in which the rear spring stop 58 is adjusted by means of tension elements and an accompanying actuating element.

FIG. 12 shows a perspective view of a mounting section 14 of a forefoot-fixing module 12, which is similar to the one on FIG. 4, except that, instead of the preloading lever 66, use is made of tension elements, spring mandrels 118 in the depicted exemplary embodiment, which interact with an actuating element formed by a multifunction eccentric 120 in the depicted exemplary embodiment. The same or corresponding components of FIG. 12 have the identical reference numbers as on the preceding figures. As evident from FIG. 12, the spring mechanism 44 in the exemplary embodiment on FIG. 12 comprises two compression springs 54, which are supported at their rear end on a rear spring stop 58, and at their front end on a front spring stop 56. Said spring mandrels 118 extend through the front spring stop 56, compression springs 54 and rear spring stop 58, and their rear ends each exhibit a nut 121, with which the rear spring stop 58 is axially held on the spring mandrels 118. A desired preloading level can be set for the two compression springs 54 via the position of the nuts 121. The term "spring unit" 117 (see FIG. 12) will be used below to denote the combination made up of the front spring stop 56 with cam surface 60, spring mandrels 118, stop bolts 119, compression springs 54, rear spring stop 58 and nuts 121. For the sake of clarity, reference number 117 is not shown on FIG. 13*a*-15*b*.

The multifunction eccentric 120 is circularly cylindrical, and has a circularly cylindrical internal hollow space 122, whose longitudinal axis is offset, i.e., "eccentrically arranged", in relation to the longitudinal axis of the outer cylinder. The multifunction eccentric 120 incorporates slits 124 extending in the circumferential direction, which each expand into an opening 126.

The front ends of the spring mandrels 118 are each provided with a head 128, which is visible on FIGS. 13*a* to 13*c*. The opening 126 is dimensioned in such a way that the head 128 of the accompanying spring mandrel 118 can be passed through it. However, the width of the slit 124 is narrower than the diameter of the heads 128. Finally, the multifunction eccentric 120 comprises an operating lever 130, whose actuation makes it possible to rotate the multifunction eccentric 120 around the central axis of the outer cylinder. The spring mandrels 118 each have a stop bolt 119, with which the compression springs 54 can be preloaded without the spring mandrels 118 being suspended on the multifunction eccentric.

How the multifunction eccentric 120 works will be explained below drawing reference to FIGS. 13*a* to 13*c*.

FIGS. 13*a* to 13*c* each show a perspective view and an accompanying sectional view depicting part of the mounting section 14 of FIG. 12 with the multifunction eccentric 120 in various positions. FIG. 13*a* shows a first position, in which the openings 126 of the multifunction eccentric 120 align with the spring mandrels 118. Correspondingly, the rear spring stop 58 is not fixed in place relative to the mounting section 14 with the multifunction eccentric 120 in this position, and the movable section 18 of the forefoot-fixing module 12 can rotate without resistance when the multifunction eccentric 120 is in this position, wherein the entire spring unit 117 comprised of the front spring stop 56, spring mandrels 118, stop bolts 119, compression springs 54, rear spring stop 58 and nuts 121 is pushed toward the back during the rotation. This position of the multifunction eccentric 120 thus provides a climbing or ski touring function, which allows an energy efficient lifting of the heel of the ski boot. Herein, the mentioned spring unit 117, which is pushed toward the back after the heel is first lifted, can remain situated in the mounting section 14, for example. As an alternative, however, the spring unit 117 can also be removed from the mounting section 14, and carried in a backpack while climbing before being used again for the downhill run. In the first position of the multifunction eccentric 120 depicted on FIG. 13*a*, the spring mandrels 118 can to this end be introduced through the accompanying openings 126, until the heads 128 come to lie in the hollow space 122 of the multifunction eccentric 120.

Activating the operating lever 130 then makes it possible to rotate the multifunction eccentric 120 into a second position shown on FIG. 13*b*. In this second position, the spring mandrels 118 no longer pass through the opening 126, but rather only through the slits 124, so that the heads 128 of the spring mandrels 118 undercut the accompanying slit 124. Descriptively speaking, the heads 128 of the spring mandrels 118 are "suspended" in the multifunction eccentric

120. At the same time, the spring mandrels 118 are pulled toward the front due to the eccentric position of the hollow space 122 of the multifunction eccentric 120 while the latter is being turned, as a result of which the rear spring stop 58 is also pulled toward the front, and the compression springs 54 can be preloaded. In the second position depicted in FIG. 13*b*, the compression springs 54 are only slightly preloaded, if at all. This corresponds to a low level exposure to a section modulus or restoring torque, for example of the kind desired for Telemark downhill skiing in deep snow.

If the multifunction eccentric 120 is further adjusted from the second position on FIG. 13*b* into the third position depicted in FIG. 13*c*, which also corresponds to the position shown on FIG. 12, the spring mandrels 118 are pulled even more toward the front, thereby further preloading the compression springs 54. This corresponds to a high level exposure to a section modulus or restoring torque, for example of the kind desired for Telemark downhill skiing under hard piste conditions.

Figure 14A:
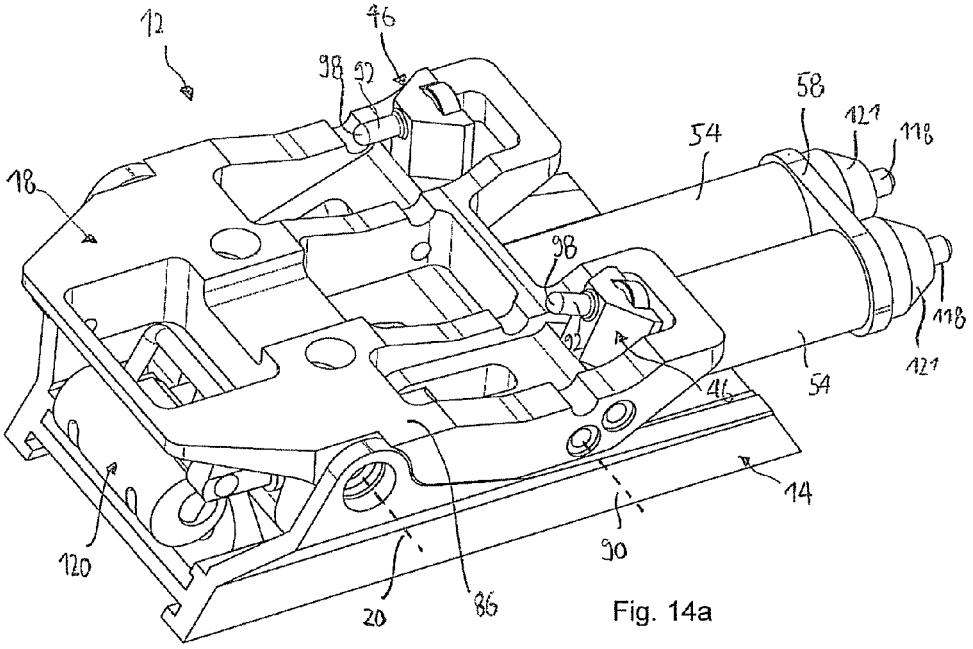
FIGS. 14*a* and 14*b* are perspective views of a forefoot-fixing module, which comprises the mounting section on FIGS. 12 and 13*a* or 13*c*, and a movable section having a design similar to that on FIG. 9.
Figure 14B:
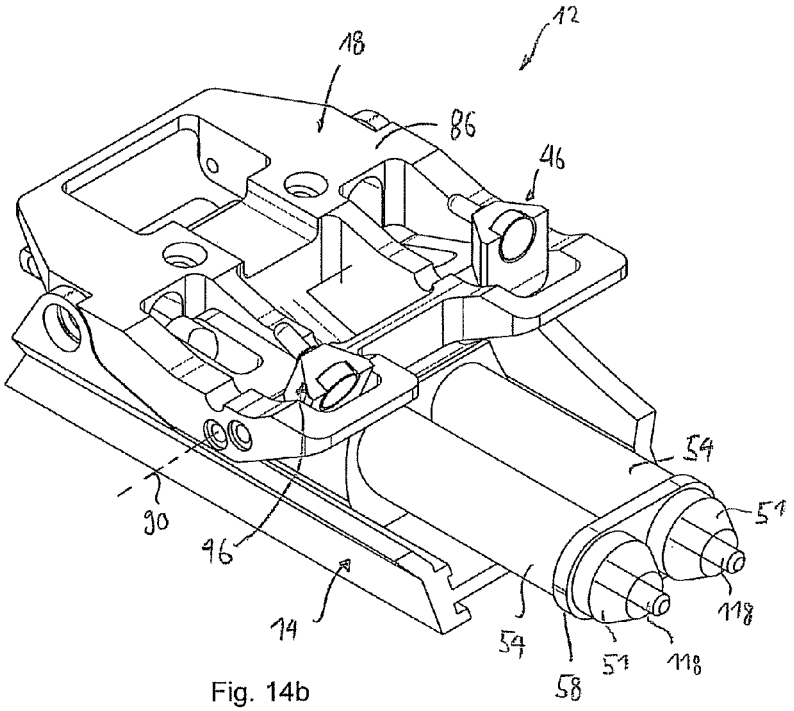
Figure 15A:
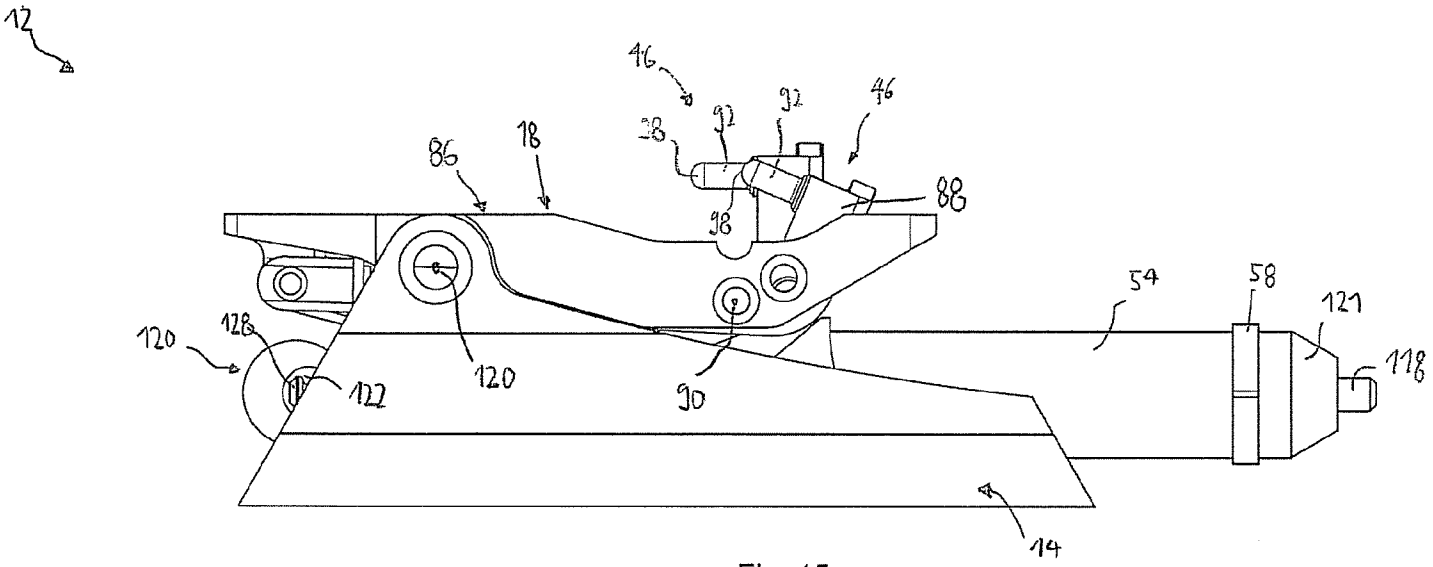
FIGS. 15*a* and 15*b* is a side view or a sectional view of the forefoot-fixing module on FIGS. 14*a* and 14*b*.
Figure 15B:
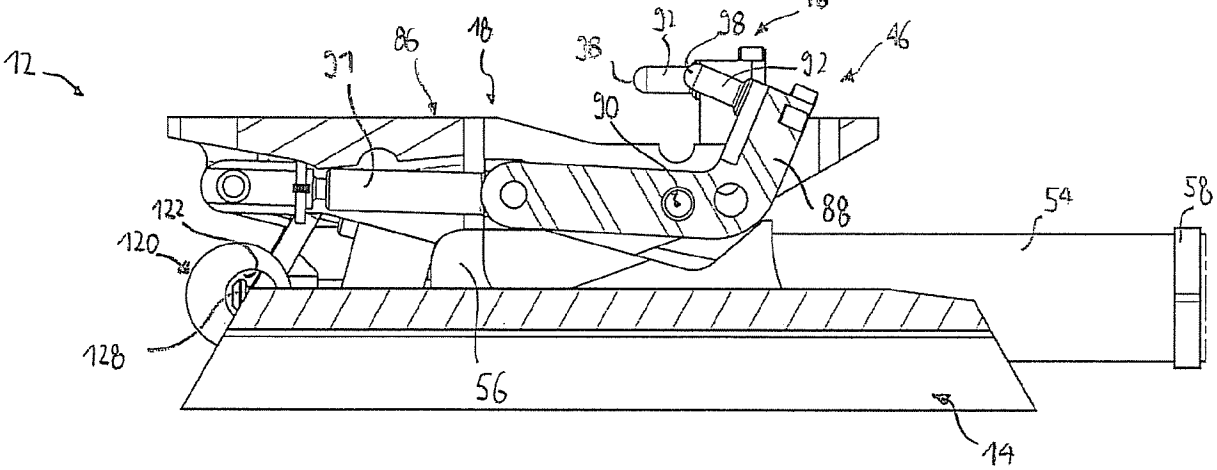

FIGS. 12 and 13*a* to 13*c* so far depicted only the mounting section 14 of the forefoot-fixing module 12. FIGS. 14*a*, 14*b*, 15*a* and 15*b* show different views of the complete forefoot-fixing module 12, comprised of the same mounting section 14 from FIGS. 12 and 13*a* to 13*c* and a movable section 18 designed similarly to the one on FIG. 9. Specifically, FIGS. 14*a* and 14*b* present two perspective top views of the forefoot-fixing module 12, and FIG. 15*b* presents a sectional side view, in which the position of the angled lever 88 becomes particularly well apparent. For the sake of clarity, the front receptacle is omitted in the illustration on FIGS. 14*a*, 14*b*, 15*a* and 15*b*, and would preferably consist of a bracket like the bracket 24 on FIG. 4.

Much the same as already described in conjunction with FIG. 9, the movable section 18 of the forefoot-fixing module 12 here also comprises a rigid base plate 86, whose rear end is provided with a rear receptacle 26 consisting of two claw-like elements 46. Here as well, the two claw-like elements 46 are formed by angled levers 88, which are hinged to the base plate 86 so that they can rotate around a horizontal axis 90, and preloaded by a spring element 91. The upper ends of the angled levers 88 are again provided with pegs or pins 92, which are intended to engage into a groove-like recess of an engagement element (not shown), which is to be fastened to or in an underside of a ski boot (not shown). The rear angled lever 88 in the illustrations on FIGS. 14*a* and 15*b* is in a closed position. The front angled lever 88 is in the dead point position, in which the spring element 91 aligns with the adjacent section of the angled lever 88. As soon as the angled lever 88 is further rotated clockwise out of this position in the illustration on FIG. 15*b*, the action exerted by the spring element 91 is reversed, and the angled lever 88 is braced in an open position.

The description of preferred exemplary embodiments and drawings serves only to illustrate the invention and advantages achieved therewith, but is not intended to limit the invention. The scope of the invention is derived solely from the following claims.

REFERENCE LIST

10, 10', 10" Ski binding
12 Forefoot-fixing module
14 Mounting section
16 Ski
18 Movable section
20 Rotational section
22 Ski boot
24 Front receptacle
26 Rear receptacle
28 Kink fold
30 Support
32 Heel element
34 cable mechanism
36 Lever
38 Cable
40 Bending resistance module
42 Element for influencing the progression of the cable 38
44 Spring mechanism
46 Claw-like element
48 Rotational axis
50 Engagement element
52 Cam surface
53 Cam surface
54 Compression spring
56 Front spring stop
58 Rear spring stop
60 Cam surface
6 Cam surface
64 Extension
66 Preloading lever
68 Rotational axis
70 Platform
72 Additional lever
74 Rotational axis
76 Recess
78 Eccentric element
80 V profile
82 Frame element
84 Beveled end surface
86 Base plate
88 Angled lever
90 Rotational axis
91 Spring element
92 Pin
94 Groove-like recess
96 Cam surface
98 Tip/end of the pin 92
100 Rolling kinematics
102 Lower part of rolling kinematics 100
104 Upper part of rolling kinematics 100
106 Upper surface of upper part 104
108 Rolling surfaces
110 Mechanical linkage
112 Lever/handlebar
114 Lower plate
116 Upper plate
118 Spring mandrel
119 Stop bolt
120 Multifunction eccentric
122 Hollow space
124 Slit
126 Opening
128 Head
130 Operating lever

What is claimed:

1. A ski binding for fastening a ski boot with a firm or flexible sole onto a ski, the ski binding comprises:

a forefoot-fixing module with a mounting section for mounting onto a ski, and a movable section that can be rotated or pivoted relative to the mounting section in such a way that at least a rear end of the movable section can be lifted off the ski; and a support for the heel of the ski boot;

wherein the movable section of the forefoot-fixing module comprises, a front receptacle for receiving a front end of the ski boot, in particular a front sole extension, and a rear receptacle, which is suitable for receiving an engagement element situated on or in the underside or to the side of the sole of the ski boot, wherein the front and rear receptacle are together suitable for fastening a front section of the ski boot in the forefoot-fixing module, and in which the front and rear receptacle of the movable section of the forefoot-fixing module are fastened to a rigid plate or a rigid frame, wherein at least one of the front and rear receptacles is associated with a releasing mechanism, which causes the front section of the ski boot to be released from the forefoot-fixing module once a threshold has been exceeded by a torque of the ski boot relative to the forefoot-fixing module, which torque corresponds to a rotation of the ski boot in the sole plane, wherein the ski binding provides one or more of the following, a Telemark downhill mode, in which the movable section of the forefoot-fixing module can be rotated or pivoted in relation to the mounting section without the front section of the ski boot received therein being bent or kinked, and in which a spring mechanism generates a restoring force, in particular a restoring torque, between the movable section and the mounting section, which counteracts a lifting of the rear end of the movable section of the forefoot-fixing module from the ski, a cross-country or climbing mode, in which the movable section of the forefoot-fixing module can be rotated or pivoted in relation to the mounting section without the front section of the ski boot received therein being bent or kinked, wherein the mechanical coupling between the movable section and the mounting section is such that, when the movable section of the forefoot-fixing module rotates or pivots by 35°, a restoring torque between the movable section and the mounting section generates a torque of less than 5 Nm.

2. The ski binding according to claim 1, in which the spring mechanism comprises a compression spring which is situated between a front and a rear spring stop, wherein, during operation, the position of the rear spring stop is fixed in place relative to the mounting section, and the movable section of the forefoot-fixing module is configured to interact with the front spring stop in such a way that the front spring stop is pushed towards the rear spring stop against a preloading of said compression spring when the rear end of the movable section of the forefoot-fixing module is moved away from the ski, wherein the position of the second spring stop can be adjusted to thereby set a restoring force or restoring torque of the spring mechanism according to the physical constitution of the skier, the terrain to be traversed and/or personal preferences.

3. The ski binding according to claim 1, in which the spring constant of the spring mechanism is chosen such that the restoring force in the Telemark downhill mode generates a torque of at least 15 Nm when the movable section of the forefoot-fixing module rotates or pivots by 35° out of the position in which the heel of the ski boot rests on the support.

4. The ski binding according to claim 1, in which the spring mechanism can be switched between at least two preset configurations, in which differing levels of restoring forces or restoring torques are generated for the Telemark downhill mode.

5. The ski binding according to claim 1, in which the spring mechanism has allocated to it a control, with which the spring mechanism can be preloaded to generate the restoring force or restoring torque, or can be preloaded while switching between said at least two preset configurations.

6. The ski binding according to claim 5, wherein the control preferably takes the form of a preloading lever, that simultaneously serves as a platform for the ski boot.

7. The ski binding according to claim 1, in which the spring mechanism comprises a compression spring, which is situated under the sole of a ski boot when received in the ski binding.

8. The ski binding according to claim 6, wherein the preloading lever accommodates an additional lever, which can interact with a section of the spring mechanism in such a way as to convert a rotating motion of the preloading lever into a preloading motion of the spring mechanism, wherein the additional lever runs through a maximum preloading dead point while preloading the spring mechanism.

9. The ski binding according to claim 1, in which at least one of the front and rear receptacles comprises at least one claw-like element, which can be moved between an open and closed position, wherein the claw-like element, when in its closed position, is suitable for engaging around or engaging into the front end of the ski boot or said engagement element, wherein the claw-like element is biased into the closed position, and wherein said release mechanism exhibits a first cam surface or abutment surface, which is associated with the receptacle, in particular with the claw-like element, wherein the first cam surface or abutment surface is designed and situated to interact with a ski-boot-fixed release element in such a way that the claw-like element can be moved into the open position by means of the ski-boot-fixed release element and the first cam surface or abutment surface when rotating the ski boot in the sole plane.

10. The ski binding according to claim 9, in which the ski-boot-fixed release element is formed by a portion of said engagement element, in particular by a cam surface or abutment surface provided on the engagement element.

11. The ski binding according to claim 9, in which the front or rear receptacle exhibits two of said claw-like elements, of which a first can be moved into the open position by inwardly rotating the ski boot, and a second by outwardly rotating the ski boot.

12. The ski binding according to claim 11, wherein the torque of the ski boot in relation to the forefoot-fixing module required for moving the claw-like element into the open position is variably adjustable for the first and second claw-like elements so that the torque required to open the first claw-like element is smaller than the torque required to open the second claw-like element.

13. The ski binding according to claim 9, in which the claw-like element can pivot between the closed and open position.

14. The ski binding according to claim 9, in which the release mechanism comprises a second cam surface or abutment surface, which is associated with the claw-like element, wherein the second cam surface or abutment surface is configured to interact with the ski-boot-fixed release element in such a way that a force exerted by the ski-boot-fixed engagement element perpendicular to the sole plane supports or counteracts said preloading force of the claw-like element in the closed position in such a way that an upward pulling force directed perpendicular to the sole plane counteracts said preloading force of the claw-like element in its closed position.

15. The ski binding according to claim 1, in which the movable section is joined by way of a roller bearing or mechanical linkage with the mounting section of the forefoot-fixing module in such a way that the movable section can be moved in relation to the mounting section so that a pure rotating or pivoting motion overlaps with a translational motion, in order to facilitate a physiologically favorable rolling of the forefoot.

* * * * *